US012004672B2

(12) United States Patent
Evangelidis et al.

(10) Patent No.: US 12,004,672 B2
(45) Date of Patent: Jun. 11, 2024

(54) PACKAGE RECEIVING DEVICE, KIT FOR ASSEMBLING THE SAME, AND CORRESPONDING METHODS OF MANUFACTURING, ASSEMBLING AND OPERATING ASSOCIATED THERETO

(71) Applicant: ALEXIA HOLDINGS INC., Dorval (CA)

(72) Inventors: Andrew Evangelidis, Pierrefonds (CA); Angelo Pasto, Montreal (CA)

(73) Assignee: ALEXIA HOLDINGS INC., Dorval (CA)

( * ) Notice: Subject to any disclaimer, the term of this patent is extended or adjusted under 35 U.S.C. 154(b) by 130 days.

(21) Appl. No.: 17/622,529

(22) PCT Filed: Jun. 26, 2020

(86) PCT No.: PCT/CA2020/050889
§ 371 (c)(1),
(2) Date: Dec. 23, 2021

(87) PCT Pub. No.: WO2020/257938
PCT Pub. Date: Dec. 30, 2020

(65) Prior Publication Data

US 2022/0346583 A1 Nov. 3, 2022

Related U.S. Application Data

(60) Provisional application No. 62/866,960, filed on Jun. 26, 2019.

(51) Int. Cl.
*A47G 29/20* (2006.01)
*A47G 29/14* (2006.01)

(52) U.S. Cl.
CPC ..... *A47G 29/20* (2013.01); *A47G 29/141* (2013.01); *A47G 2029/146* (2013.01); *A47G 2200/085* (2013.01)

(58) Field of Classification Search
CPC ..... A47G 29/20; A47G 29/141; A47G 29/22; A47G 29/30; A47G 2029/145;
(Continued)

(56) References Cited

U.S. PATENT DOCUMENTS 922,181 A * 5/1909 Ohlson ..... A47G 29/12095 232/38
2,456,479 A * 12/1948 Antil ..... B65D 9/14 312/258
(Continued)

FOREIGN PATENT DOCUMENTS

CN 108523605 A 9/2018
CN 209315494 U 8/2019
(Continued)

OTHER PUBLICATIONS

International Search Report and Written Opinion of the International Searching Authority for International Patent Application No. PCT/CA2020/050889 dated Sep. 2, 2020, 8 pages.
(Continued)

*Primary Examiner* — William L Miller
(74) *Attorney, Agent, or Firm* — Merchant & Gould P.C.

(57) ABSTRACT

A package receiving device (1) for receiving a package (3) includes a mounting panel (5*a*), a bottom panel (5*b*) and at least one side panel (7). The package receiving device (1) and corresponding panels (5,7) thereof being operable in at least one first configuration where the mounting, bottom and side panels (5*a*,5*b*,7) are collapsed onto one another into a reduced space, with the at least one side panel (7) being placeable between the bottom and mounting panels (5*b*,5*a*), and being containable within a spanning width (1) defined by the bottom and mounting panels (5*b*,5*a*). The package receiving device (1) and corresponding panels (5,7) thereof being further operable in at least one second configuration where the panels (5,7) are deployed and positioned with
(Continued)

respect to one another in order to define a containment space being shaped and sized for containing the package (3) therein.

21 Claims, 11 Drawing Sheets

(58) Field of Classification Search
CPC ..... A47G 2029/146; A47G 2200/085; B65D 7/26; B65D 9/14; B65D 15/24; B65D 21/086
See application file for complete search history.

(56) References Cited

U.S. PATENT DOCUMENTS

| | | | | |
|---|---|---|---|---|
| 2,750,105 | A * | 6/1956 | Wixom | A47G 29/12 232/19 |
| 6,426,699 | B1 * | 7/2002 | Porter | A47F 10/00 340/568.1 |
| D679,116 | S | 4/2013 | Evangelidis | |
| 9,125,488 | B2 | 9/2015 | Evangelidis | |
| 9,861,221 | B2 | 1/2018 | Shuia | |
| 10,321,780 | B1 * | 6/2019 | James | A47G 29/141 |
| 10,537,196 | B1 | 1/2020 | MacPherson | |
| 10,588,439 | B2 | 3/2020 | Charbeneau | |
| 10,588,440 | B1 | 3/2020 | Kajgana | |
| 10,709,276 | B2 * | 7/2020 | Guanch | A47G 29/20 |
| 10,743,695 | B1 * | 8/2020 | Altmaier | B60R 9/065 |
| 10,786,103 | B2 * | 9/2020 | Teoh | B65D 11/1853 |
| 11,197,566 | B2 * | 12/2021 | Aresu | A47G 29/124 |
| 11,246,443 | B2 * | 2/2022 | Lin | A47G 29/141 |
| 11,278,144 | B2 * | 3/2022 | Vernal Silva | A47G 29/141 |
| 11,510,517 | B2 * | 11/2022 | McLean | B65D 11/1853 |
| 11,617,465 | B2 * | 4/2023 | Zhang | A47G 29/141 232/38 |
| 11,666,169 | B1 * | 6/2023 | Altmaier | A47G 29/20 232/33 |
| 11,751,708 | B2 * | 9/2023 | Wu | A47G 29/141 232/19 |
| 2017/0286905 | A1 * | 10/2017 | Richardson | G06Q 10/0832 |
| 2018/0070753 | A1 * | 3/2018 | Eveloff | H04W 4/025 |
| 2018/0296016 | A1 | 10/2018 | Teoh | |
| 2019/0225375 | A1 * | 7/2019 | Sena | A47G 29/20 |
| 2019/0320836 | A1 | 10/2019 | Guanch et al. | |
| 2019/0350398 | A1 | 11/2019 | Raphael et al. | |
| 2020/0015616 | A1 | 1/2020 | Sankaran | |
| 2021/0355741 | A1 * | 11/2021 | Chiappetta | A47G 29/141 |
| 2022/0248888 | A1 * | 8/2022 | Willhoit | A47L 23/266 |
| 2022/0257041 | A1 * | 8/2022 | Redford | B65D 11/186 |
| 2022/0267048 | A1 * | 8/2022 | Rogers | A47G 29/141 |

FOREIGN PATENT DOCUMENTS

| | | | |
|---|---|---|---|
| CN | 110367792 | A | 10/2019 |
| CN | 110367796 | A | 10/2019 |
| JP | 11152799 | | 4/2005 |
| KR | 20-0476136 | Y1 | 2/2015 |
| KR | 20160107894 | | 9/2016 |
| KR | 10-1990621 | B1 | 6/2019 |
| NL | 2019060 | | 12/2018 |
| WO | 2011/043542 | A1 | 4/2011 |
| WO | 2017/014521 | A1 | 1/2017 |
| WO | 2020/024900 | A1 | 2/2020 |
| WO | 2020/042857 | A1 | 3/2020 |

OTHER PUBLICATIONS

"The Porch Pirate Chest", The Porch Pirate, 5 pages (2019), https://www.amazon.com/Porch-Pirate-Chest-Collapsible-Permanently/dp/B07NDHSHCL.

* cited by examiner

PACKAGE RECEIVING DEVICE, KIT FOR ASSEMBLING THE SAME, AND CORRESPONDING METHODS OF MANUFACTURING, ASSEMBLING AND OPERATING ASSOCIATED THERETO

CROSS-REFERENCE TO RELATED APPLICATIONS

This application is a National Stage Application of PCT/CA2020/050889, filed 26 Jun. 2020, which claims benefit of U.S. Provisional Patent Application Ser. No. 62/866,960, filed 26 Jun. 2019, and which applications are incorporated herein by reference. To the extent appropriate, a claim of priority is made to each of the above-disclosed applications.

FIELD OF THE INVENTION

The present invention relates to the field of delivering and receiving packages, parcels, mail and/or the like. More particularly, the present invention relates to a package receiving device (which can also be used as a package expediting device), and also relates to a kit with corresponding components for assembling the same, and to corresponding methods of manufacturing, assembling and/or operating associated thereto.

BACKGROUND

Known in the art are the various drawbacks associated with the traditional way of receiving and expediting packages, parcels and the like. Namely, most packages are too large to be fit into a conventional mailbox. As a result, when a package is delivered to a home, in some cases, it is left in front and/or proximity to the door, therefore, exposed to everyone and subject to "theft", which is very undesirable for all of the parties involved (ex. recipient, delivery person and/or delivery company, insurance companies, etc.). Even if not stolen, because the package is typically left "outside", it is subject to weather conditions (ex. sun, wind, rain, snow, freezing conditions, etc.), and thus, because most packages are left outside during many hours until the associated recipient returns home (typically, after work, or maybe even later), the package, including the packaging and/or content thereof, may be greatly damaged due to the weather conditions, which is also very undesirable, for many obvious reasons. In some other cases, delivery companies will not leave the package at the home, but instead, will leave a corresponding delivery notice, forcing the associated recipient to deploy lots of time, energy and efforts, to contact the delivery company in order to work out new possible delivery date(s), time(s) and/or destinations(s), which is a very long and tedious process for all the people involved. In some cases even, the associated recipient will have to deploy lots of time, energy and efforts, including corresponding displacements, in order to recover the package at a corresponding storing facility of the delivery company. In other cases, the package will be left in front and/or proximity to the door, with all of the drawbacks mentioned above, but also, with the additional drawback that the delivery person/company will send a picture of the delivered package to the intended recipient (ex. typically, via text and/or email), causing a certain level of "anxiety" to said intended recipient, knowing that the package may be stolen and/or weather-damaged, and in many cases, forcing them to leave early (either from work, school, etc.) to recover the package as soon as possible, which is also very undesirable not only for the intended recipient (ex. having to miss and/or make up missed work, school, etc.), but also for the corresponding employers and educational institutions, etc.

Also known in the art are conventional devices used for receiving, containing and/or delivering packages.

For example, US patent application No. 2020/0015616 A1, in the name of SANKARAN, and made public on Jan. 16, 2020, relates to a "collapsible wall mounted security box for packages". This document describes a device having a front, top, bottom and side panel components, in which each panel includes a front panel mesh and a surrounding bar portion, wherein said surrounding bar portion is configured to support said front panel mesh, a first locking mechanism, a second locking mechanism, a back support panel component configured to be operable for mounting onto a wall with screws, and a hinge mechanism, wherein said hinge mechanism is configured to be operable for allowing the device to be folded or collapsed when not in use.

Also known is a product commercialized on Amazon™ under the name "The Porch Pirate Chest", and described in the following link: https://www.amazon.com/Porch-Pirate-Chest-Collapsible-Permanently/dp/B07NDHSHCL.

Document No. KR 101990621 B1 granted on Jun. 18, 2019, and based on an English translation of the abstract, describes a personal courier device according to an embodiment of the invention which includes a courier box frame disposed at a desired installation location of a courier item, a plurality of second courier boxes arranged in a folded shape on a front portion of the courier box frame, a door frame connected to a bag inlet portion formed on an upper portion of the article storage portion and connected to the upper portion of the cabin container frame so as to be rotatable or movable, and an opening/closing door that is rotatably or movably connected to the door frame and opens/closes a first doorway formed at the center of the door frame so as to communicate with the bag mouthpiece. The storage unit may be folded or unfolded according to a change in the position of the door frame.

Document No. WO2020042857A1 made public on Apr. 5, 2020, and based on an English translation of the abstract, describes an object access device, comprising a frame body; an accommodating part, having an object storage state and a folded state, the accommodating part comprising a sealing frame and an opening door which are both rotatably disposed on the frame body, and the sealing frame being configured to seal an object storage space between an opening door accommodating part and an opening door frame body in an opening door object storage state; a first locking component, configured to achieve locking between the sealing frame and the frame body, and allow the opening of the object access device after unlocking; and a second locking component, configured to achieve locking between the sealing frame and the opening door, and allow switching of the accommodating part from the folded state to the object accommodating state after unlocking. According to such an object access device, separate locking between the sealing frame and the opening door and between the sealing frame and the frame structure is not required, so that a locking structure can be simplified, production costs are reduced, and the operation complexity can further be reduced.

Document No. WO2020024900A1 made public on Feb. 6, 2020, and based on an English translation of the abstract, describes a goods storage device, comprising a frame body, which is configured to be fixed onto a vertical mounting surface; a cover body, which is hinged with the frame body at the upper end, the left end, or the right end to achieve rotation and opening and closing; and a container, of which an opening end is provided on the inner wall of the cover body and located in a space formed between the frame body and the cover body. The container is variable in the volume, and is configured to be unfolded to form a space containing goods after the cover body is opened with respect to the frame body, and allow the cover body to be closed with respect to the frame body after the container is folded. The goods storage device enables the storage of goods to be more convenient and saves a waiting time duration; moreover, by providing the foldable container, facilitating the goods storage device folding when not in use, so that the occupied space is reduced, and the whole structure is simple.

Document No. WO2017014521A1 made public on Jan. 26, 2017, and based on an English translation of the abstract, describes a foldable unmanned home-delivered article storage box, which can be easily fixed/installed on the front door and uninstalled, as needed, and which can be unfolded and then folded conveniently and quickly, in order to store an article. The foldable unmanned home-delivered article storage box according to the invention comprises: a back plate, which is formed to have a U-shaped section when seen from above, and which is installed in an upright position; a pair of side plates connected/installed to both end corners of the U-shaped back plate to be foldable, and which are installed such that the longitudinal middle parts thereof can be bent inwards and folded; a front plate formed in a shape corresponding to that of the back plate such that the opposite end corners of the pair of side plates are connected to both end corners of the front plate to be foldable, and which has a locking device installed on the upper end thereof; a bottom plate, one end corner of which is rotatably connected/installed to the lower end of the back plate, and which constitutes the bottom of a space formed when the pair of side plates are unfolded; and a cover plate, one end corner of which is rotatably connected/installed to the upper end of the back plate, which has a locking groove formed on the opposite end corner thereof such that the locking device is fastened thereto, and which covers the upper surface of the space formed when the pair of side plates are unfolded.

Document No. WO2011043542A2 made public on Apr. 14, 2011, and based on an English translation of the abstract, describes an unmanned home delivery receiving box, and more particularly, to an unmanned home delivery receiving box which can be installed in a separate house or in a multiplex housing unit rather than in large-scale residential areas, which is not installed on a door to prevent security problems, and which enables users to safely receive parcels without the risk of theft even in the event no one is home. The unmanned home delivery receiving box according to the present invention comprises: a main body mounted on a wall, which is formed by overlapping a plurality of unit bodies and the length of which is adjustable by the degree of overlap of the unit bodies; a door arranged at the end unit body of the unit bodies and having a keypad for locking or unlocking the door; and a box for receiving the main body, having a receiving box door for opening/shutting the front surface of the receiving box, and a support having one end fixed at the receiving box door and the other end fixed at the main body so as to support the receiving box door when the receiving box door is opened/shut. A roller is formed on the lower portion of the unit body having the door, and the receiving box door opens to support the roller when the length of the main body is adjusted. U.S. Pat. No. 9,861,221 B2, in the name of JIANG, and granted on Jan. 9, 2018, relates to "package receiving systems and methods". This document describes a package receiving device, the package receiving device includes a sensor configured to obtain package identifying information from a package, a verification module configured to determine if the package identifying information matches information stored in a computer-readable storage media, and a receptacle configured to change from a compact mode to an extended mode to secure the package based on a determination of the verification module. Securing the package includes enclosing the package in the receptacle.

US patent application No. 2019/0320836 A1, in the name of GUANCH et al., and made public on Oct. 24, 2019, relates to a "collapsible delivery storage assembly". This document describes a collapsible delivery storage assembly which includes a panel that is mounted to an exterior wall of a building and the panel has a recess therein. A storage unit is movably coupled to the panel and the storage unit is positionable in a collapsed position having the storage unit being positioned in the recess. The storage unit is positionable in a deployed position such that the storage unit defines a box for receiving a package delivery. A door is hingedly coupled to the storage unit to close the box. A combination lock is coupled to the door and the combination lock releasably engages the storage unit when the door closes the box. Thus, the combination lock restricts access to the package in the box.

Document No. CN108523605A made public on Sep. 14, 2018, and based on an English translation of the abstract, describes a kind of intelligent wall hanging formula inboxes, including fixed plate. By being designed with the express delivery inbox, the inbox when not in use can recycle nettle and rope relative to fixed plate. The inside by seal closure relative to baffle is recycled again. Baffle is overlapped relative to fixed plate, so that inbox small volume when not in use. It is adapted for mount to the doorway position of every household, to carry out the placement of express delivery. After button press opens the nettle structure of the inbox, so that the inbox has larger memory space. Prodigious express delivery can be stored in the inside of the inbox by courier, and the inbox has intelligent function. Courier and receiver, which by control panel can input password or scan corresponding Quick Response Code at camera, carries out unlatching work to the inbox seal closure. To carry out the normal storage to commodity and work of taking, it can be seen that this kind is invented, practical function, and is suitable to be widely popularized.

Document No. KR200476136Y1 made public on Jan. 27, 2015, and based on an English translation of the abstract, describes a courier cabinet which is installed on a front door and unattended to receive a courier, and more particularly, a right side part connected to the front part and the rear part and divided into a front plate and a rear plate, a left part divided from the front plate and the rear plate and connected to the front plate and the rear plate, a front plate connected to the front plate, a bottom plate divided into a first left plate connected to the left side and a second left plate connected to the right side, the first right plate connected to the right side, the second right plate connected to the right side. The front plate and the rear plate are mutually folded, the front plate and the rear plate of the left side portion are folded each other, the front plate of the bottom portion is folded toward the front side, wherein the first right side plate and the second right side plate are folded to each other and the first left side plate and the second left side plate are folded so that the courier case is folded and unfolded in the reverse order. The invention relates to an installable courier.

U.S. Pat. No. 10,588,439 B2, in the name of CHARBENEAU, and granted on Mar. 17, 2020, relates to a "parcel receiving apparatus, collapsible bin and associated methods". This document describes a parcel bin for a parcel receiving apparatus that includes a receiving plate, a rotatable delivery plate, and a pair of parcel bin sides. The parcel bin sides include a pair of receiving plate sides and a pair of delivery plate sides. The pair of delivery plate sides are structured to be collapsible toward the delivery plate. The pair of receiving plate sides are fixedly attached to the receiving plate and structured to be non-rotatable. The rotatable delivery plate is structured to be collapsible toward the receiving plate.

U.S. Pat. No. 10,588,440 B2, in the name of KAJGANA, and granted on Mar. 17, 2020, relates to a "delivery box built in garage door". This document explains that to prevent the theft of packages and increase the reliability and security of delivered packages from consignor to a consignee, it is necessary to create a secured delivery box built into a garage door. The delivery box built in garage door includes an opening in garage door, built in housing with sliding lid, or pivoting lid, on input opening. The housing has one or two output openings on a sides or bottom. Also, the housing of the delivery box has an optionally sloped floor on either a single side or both sides, or flat floors, or rolling conveyor floor or a ball rolling conveyor floor.

Also known, and belonging to the Applicant/Assignee of the present case, is U.S. Pat. No. 9,125,488 B2 in the name of EVANGELIDIS, granted on Sep. 8, 2015, and relating to a "replaceable front panel system for use with storage modules". This document describes a replaceable front panel system for use with a storage module, including a chassis defining a structural configuration of the front panel system, and a removable covering skin configured to at least in part surround the chassis, the removable covering skin defining one or more exterior surfaces of the front panel system. Also provided is a kit for customizing the appearance of a door or drawer front for a storage cabinet module comprising a covering skin configured to at least in part surround a chassis of the door or drawer front, and optionally, an installation tool, and a method for installing the covering skin onto a chassis.

Also known, and belonging to the Applicant/Assignee of the present case is U.S. Design Pat. No. D679,116S granted on Apr. 2, 2013, in the name of EVANGELIDIS, and relating to a "modular storage unit set".

Despite these improvements over the years, there is always a need to continue innovating and finding better and/or different ways of receiving, containing and/or delivering packages, for example, and to be able do so, in a quicker, easier, simpler, faster, more efficient, more convenient, more reliable, more secure and/or more sustainable manner.

Therefore, it would be particularly useful to be able to provide an improved system which would be able to overcome or at the very least minimize some of known drawbacks associated with the conventional ways and devices used for receiving packages, parcels and the like, for example.

SUMMARY OF THE INVENTION

An object of the present invention is to provide a package receiving device which, by virtue of its design and components, would be an improvement over other related conventional delivery/storage devices and/or methods known in the prior art.

In accordance with the present invention, the above object is achieved, as will be easily understood from the present description, with a package receiving device (also referred to herein simply as "device" and/or "system") such as the one briefly described herein and such as the one exemplified in the accompanying drawing(s).

More particularly, according to one aspect of the present invention, an object is to provide a package receiving device for receiving a package, the package receiving device comprising:

- a mounting panel for securely mounting the package receiving device onto a given fixed structure;
- a bottom panel being operatively connectable to the mounting panel and being moveable with respect to said mounting panel; and
- at least side panel being operatively connectable to the bottom panel and being moveable with respect to said bottom panel;
- the package receiving device and corresponding panels thereof being operable between at least one first configuration where the mounting, bottom and side panels are collapsed onto one another into a reduced space, with the at least one side panel being placeable between the bottom and mounting panels, and being containable within a spanning width defined by said bottom and mounting panels, the package receiving device and corresponding panels thereof being further operable into at least one second configuration where the panels are deployed and positioned with respect to one another in order to define a containment space being shaped and sized for containing the package therein.

According to yet another aspect of the invention, there is also provided a method of manufacturing components of the above-mentioned package receiving device.

According to yet another aspect of the invention, there is also provided a method of assembling components of the above-mentioned package receiving device.

According to yet another aspect of the invention, there is also provided a method of using the above-mentioned package receiving device and/or component(s) thereof.

According to yet another aspect of the invention, there is also provided a kit with components for assembling the above-mentioned package receiving device.

According to yet another aspect of the present invention, there is also provided a set of components for interchanging with components of the above-mentioned kit.

According to yet another aspect of the present invention, there is also provided a method of assembling components of the above-mentioned kit and/or set.

According to yet another aspect of the present invention, there is also provided a method of receiving and/or storing a package with the above-mentioned package receiving device, component(s) thereof, kit, set and/or method(s).

According to yet another aspect of the present invention, there is also provided a method of doing business with the above-mentioned package receiving device, component(s) thereof, kit, set and/or method(s).

The objects, advantages, and other features of the present invention will become more apparent upon reading of the following non-restrictive description of preferred embodiments thereof, given for the purpose of exemplification only, with reference to the accompanying drawings.

DETAILED DESCRIPTION OF PREFERRED EMBODIMENTS OF THE INVENTION

Figure 1:
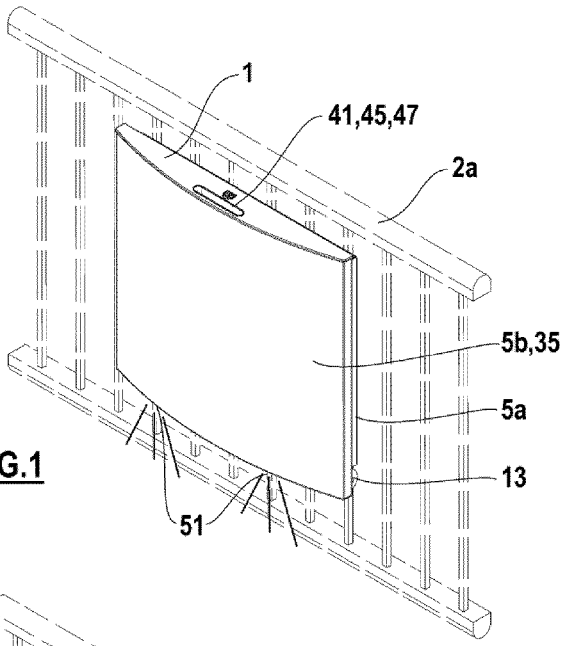
FIG. 1 is a front perspective view of a package receiving device according to a possible embodiment of the present invention, the package receiving device being shown in a first configuration (i.e. undeployed configuration), and being further shown mounted onto a corresponding schematic representation of a railing, as well as with a pair of light emitting devices being shown in an operative lighting mode.
Figure 2:
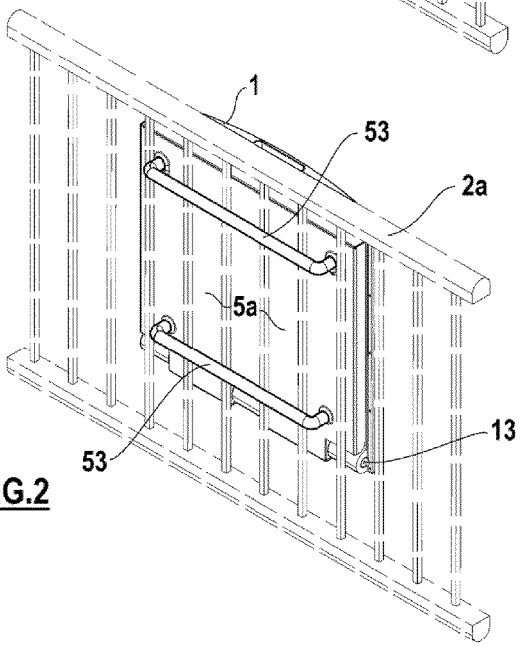
FIG. 2 is a rear perspective view of what is shown in FIG. 1.
Figure 3:
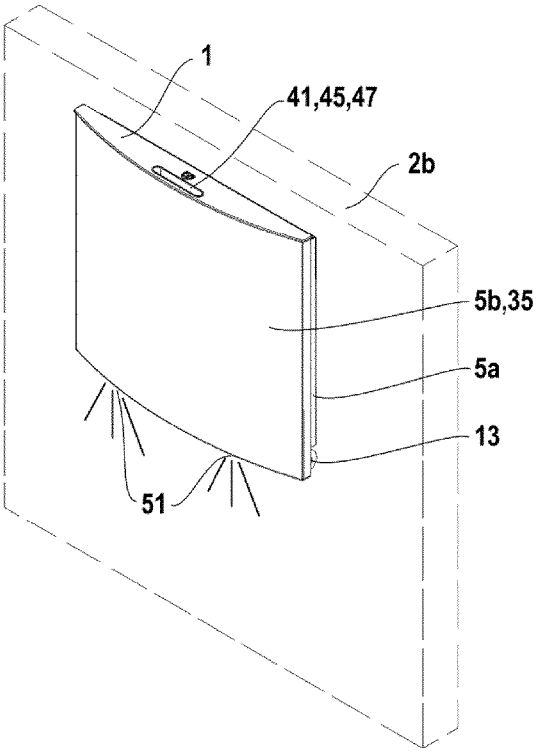
FIG. 3 is a front perspective view of a package receiving device according to another possible embodiment of the present invention, the package receiving device being shown in a first configuration (i.e. undeployed configuration), and being further shown mounted onto a corresponding schematic representation of a wall, as well as with a pair of light emitting devices being shown in an operative lighting mode.
Figure 4:
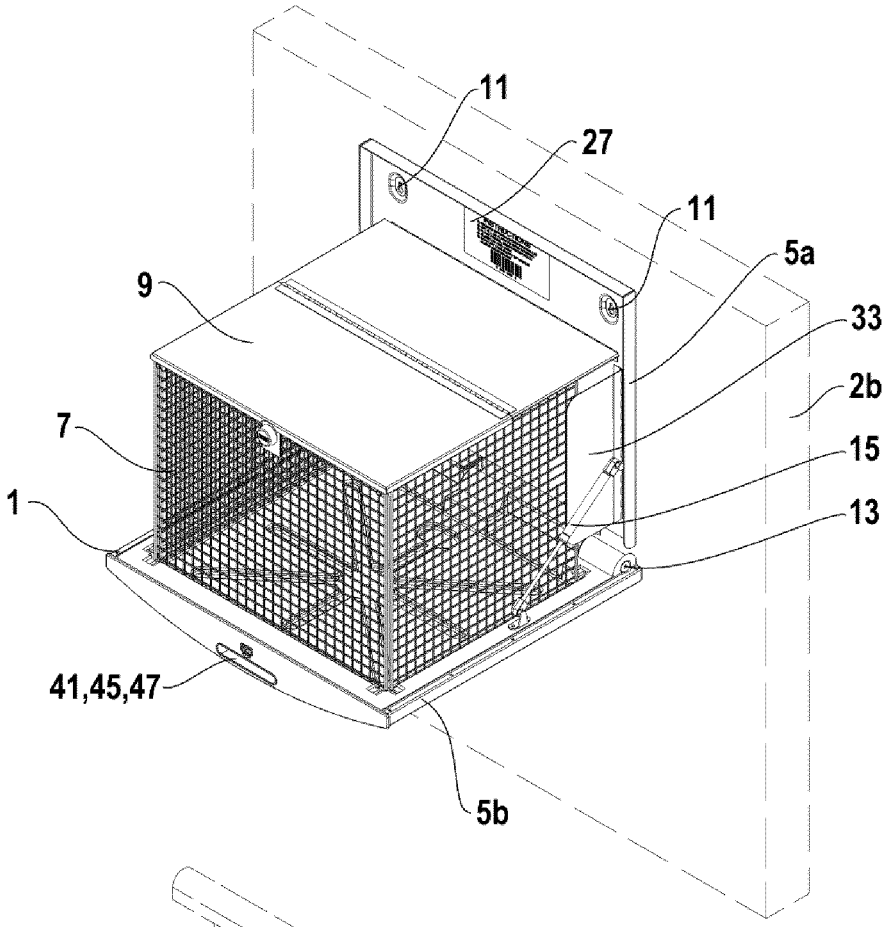
FIG. 4 is another front perspective view of what is shown in FIG. 3, the package receiving device being now shown in a second configuration (i.e. fully deployed and closed configuration).
Figure 5:
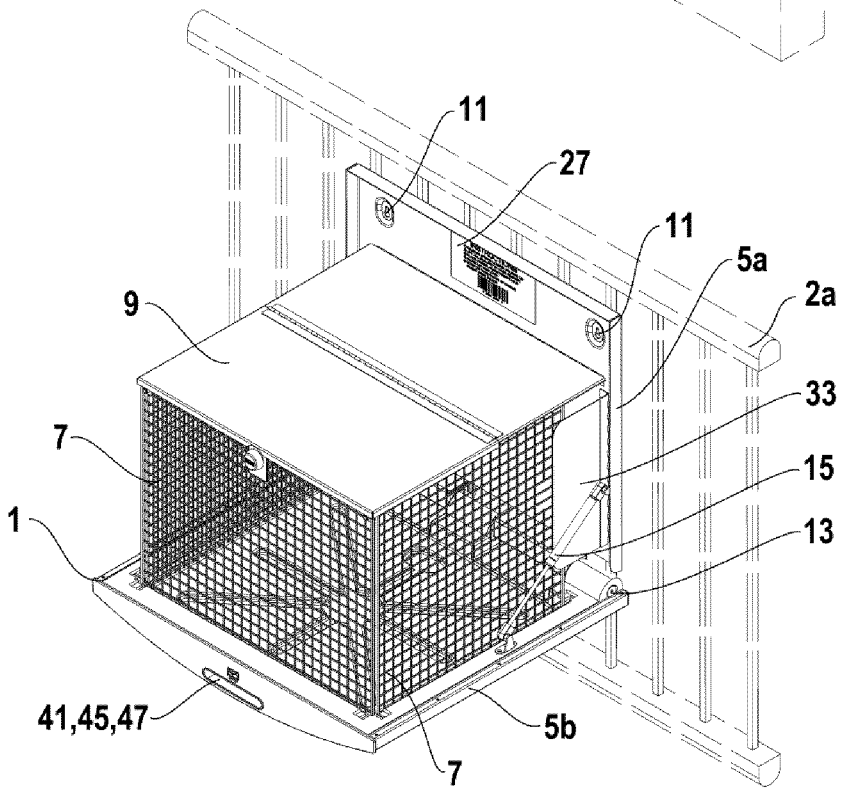
FIG. 5 is another front perspective view of what is shown in FIG. 1, the package receiving device being now shown in a second configuration (i.e. fully deployed and closed configuration).
Figure 6:
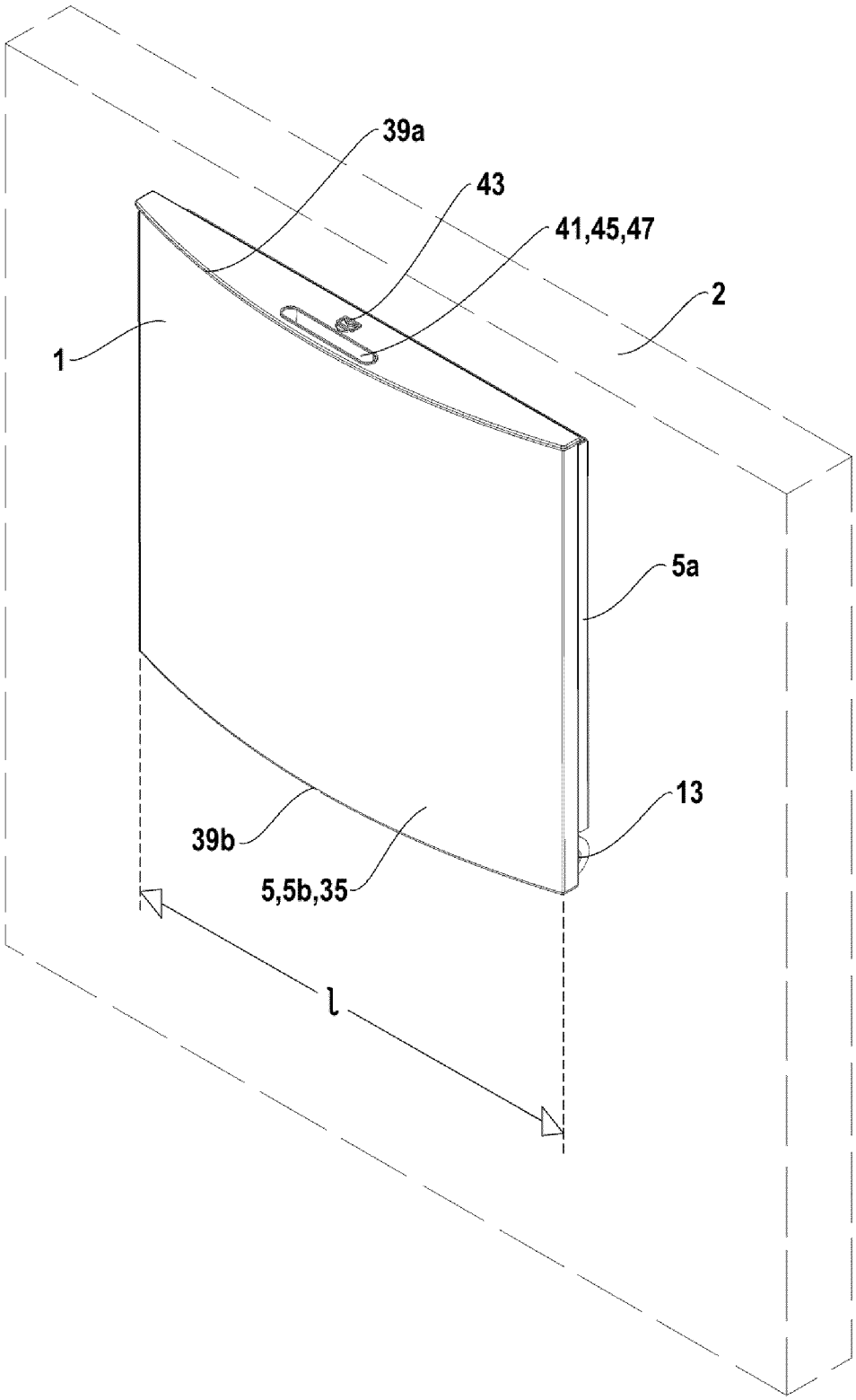
FIG. 6 is an enlarged view of what is shown in FIG. 3, the package receiving device being now shown with its pair of light emitting devices in an inoperative mode.
Figure 7:
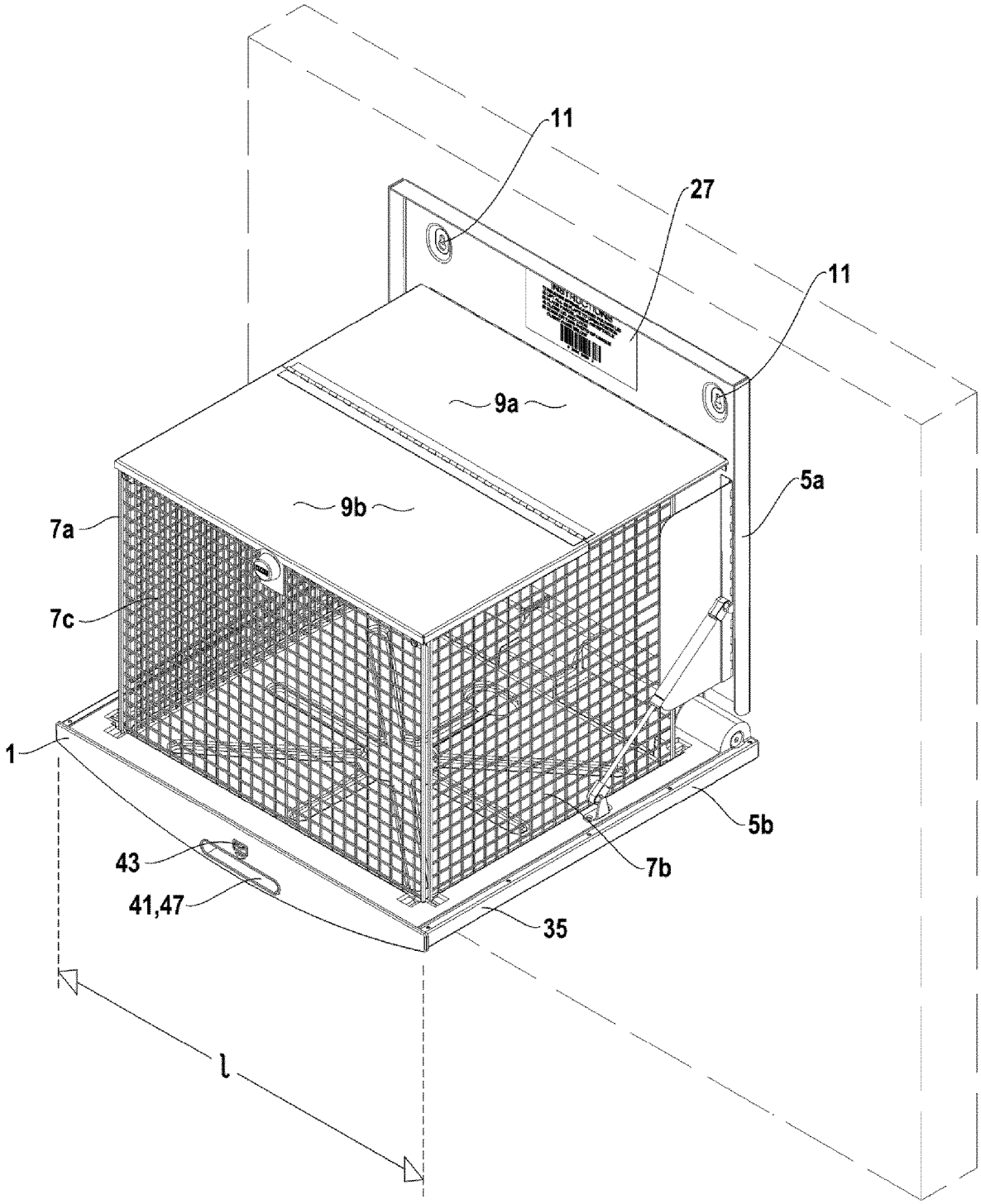
FIG. 7 is an enlarged view of what is shown in FIG. 4.
Figure 8:
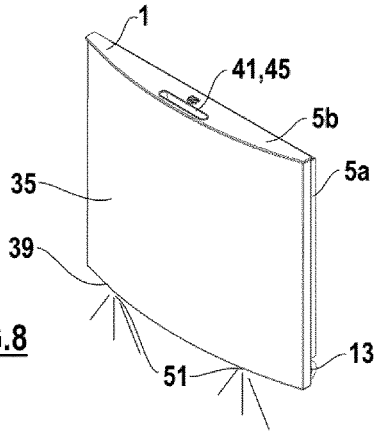
FIGS. 8-19 are different views of various aspects, components, configurations and features of the package receiving device of FIG. 3, including a possible sequential series of steps for operating the package receiving device from an initial fully collapsed configuration to a final fully deployed and fully closed/secured configuration, according to a possible embodiment of the present invention.
Figure 9:
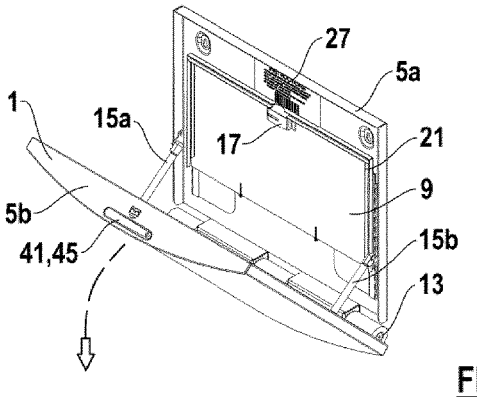
Figure 10:
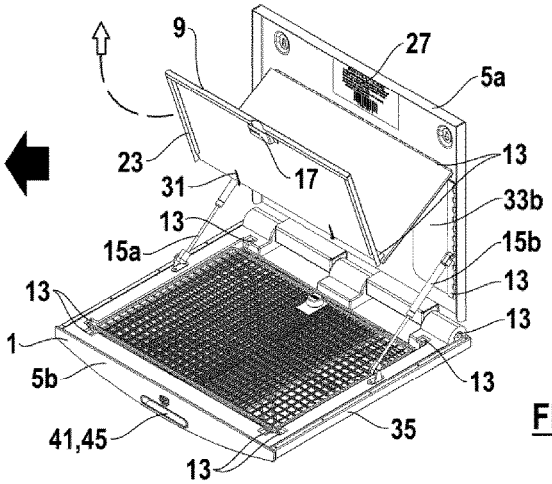
Figure 11:
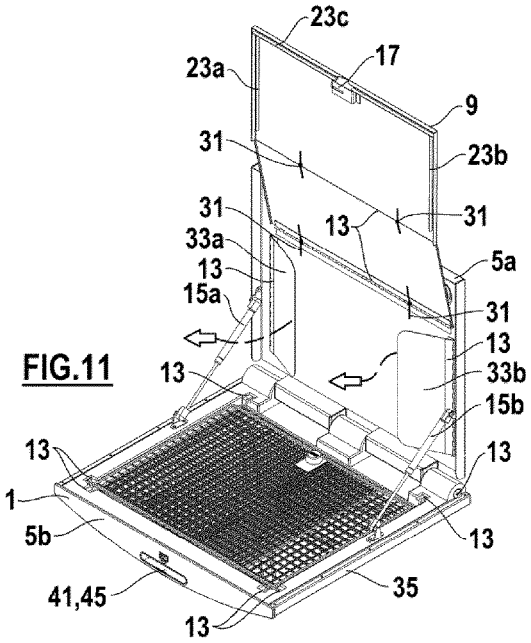
Figure 12:
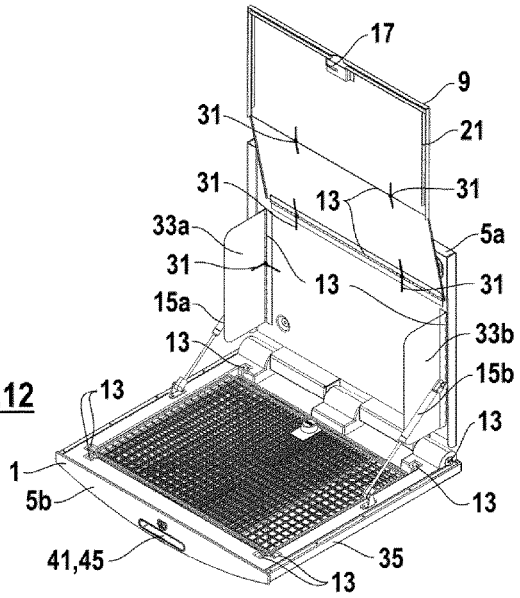
Figure 13:
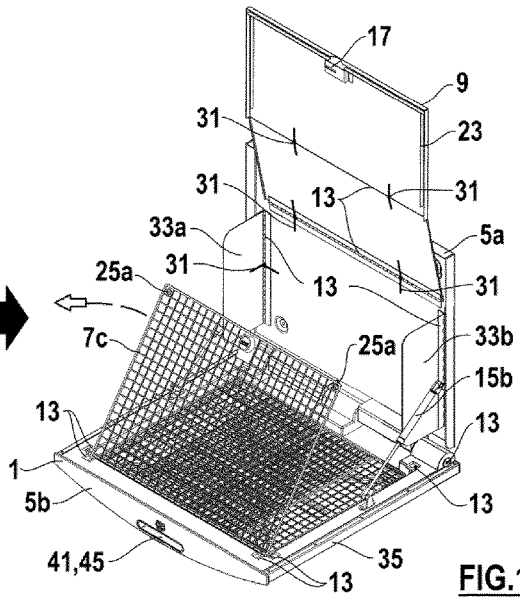
Figure 14:
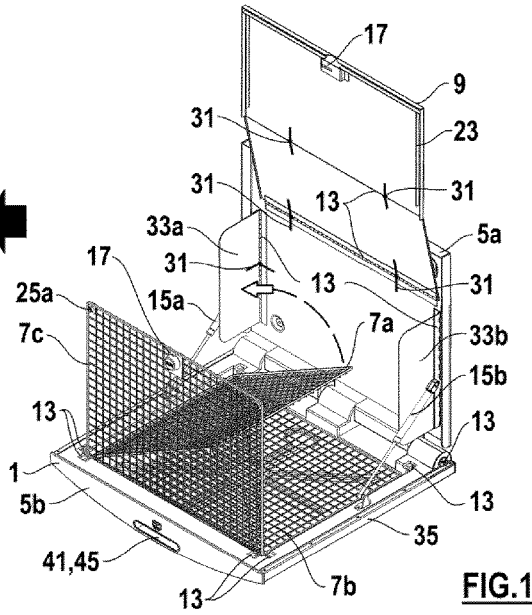
Figure 15:
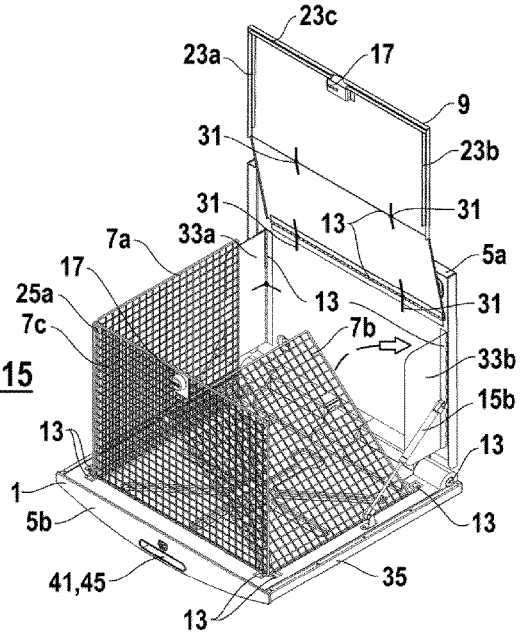
Figure 16:
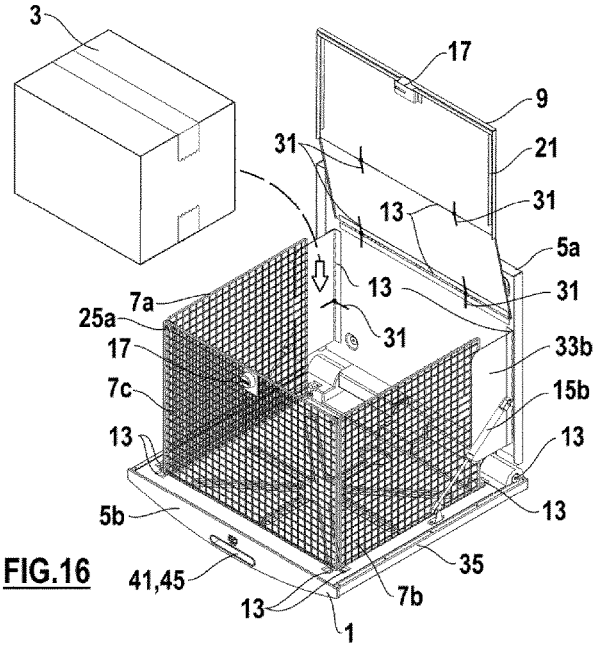
Figure 17:
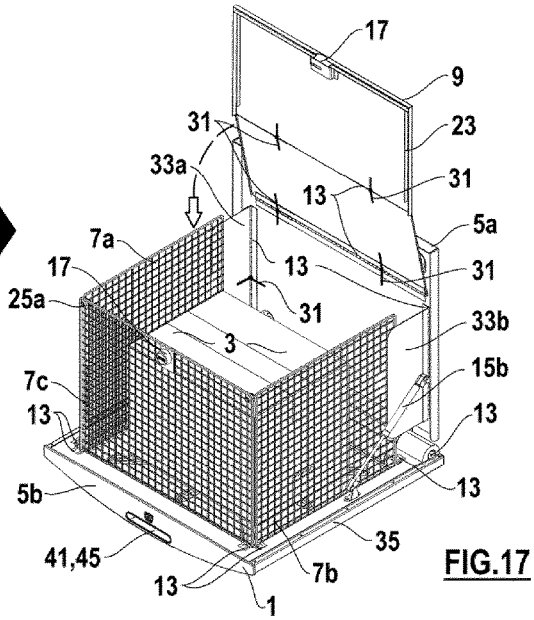
Figure 18:
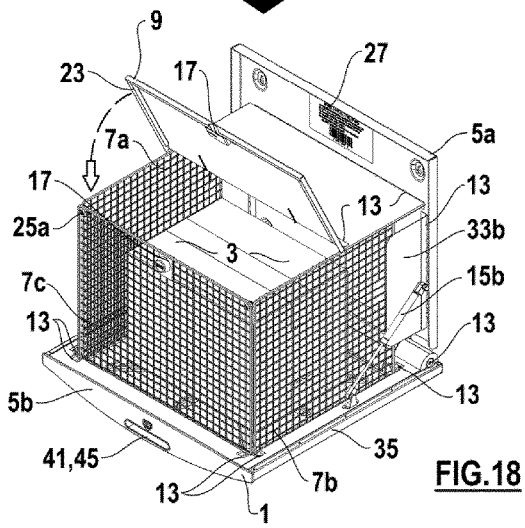
Figure 19:
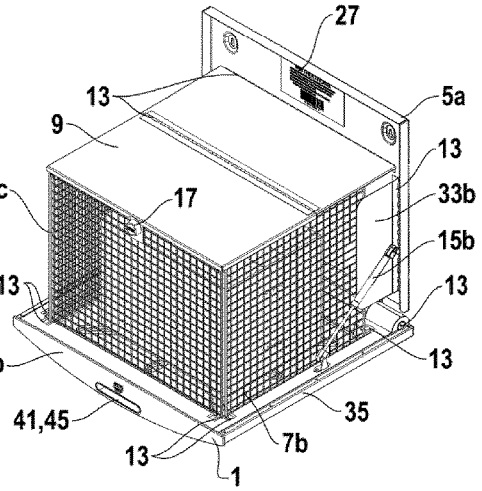
Figure 20:
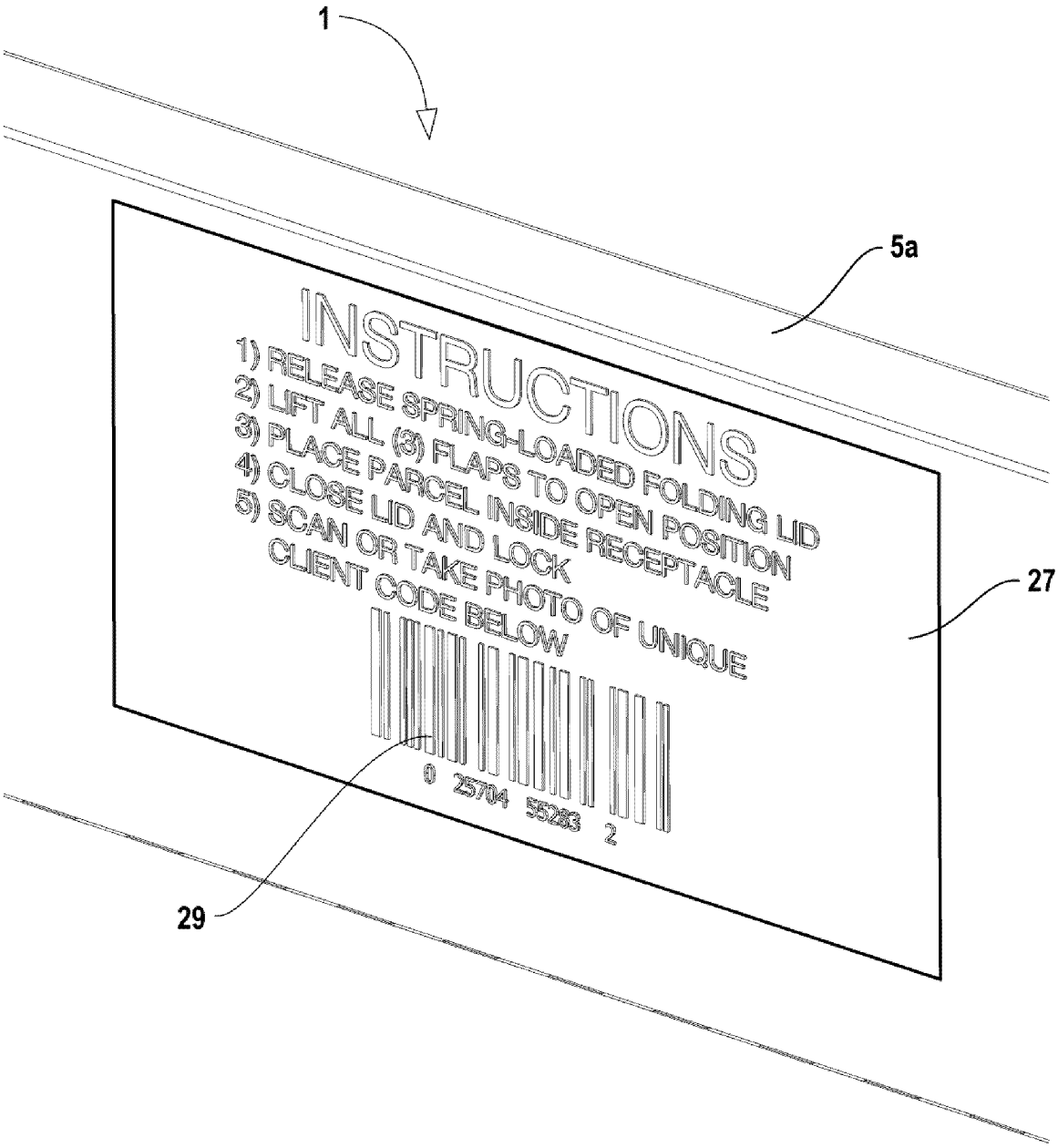
FIG. 20 is an enlarged view of a portion of the package receiving device shown in FIG. 7 to better illustrate a set of information and/or instructions, as well as an associated user identification code of the package receiving device, according to a possible embodiment of the present invention.
Figure 21:
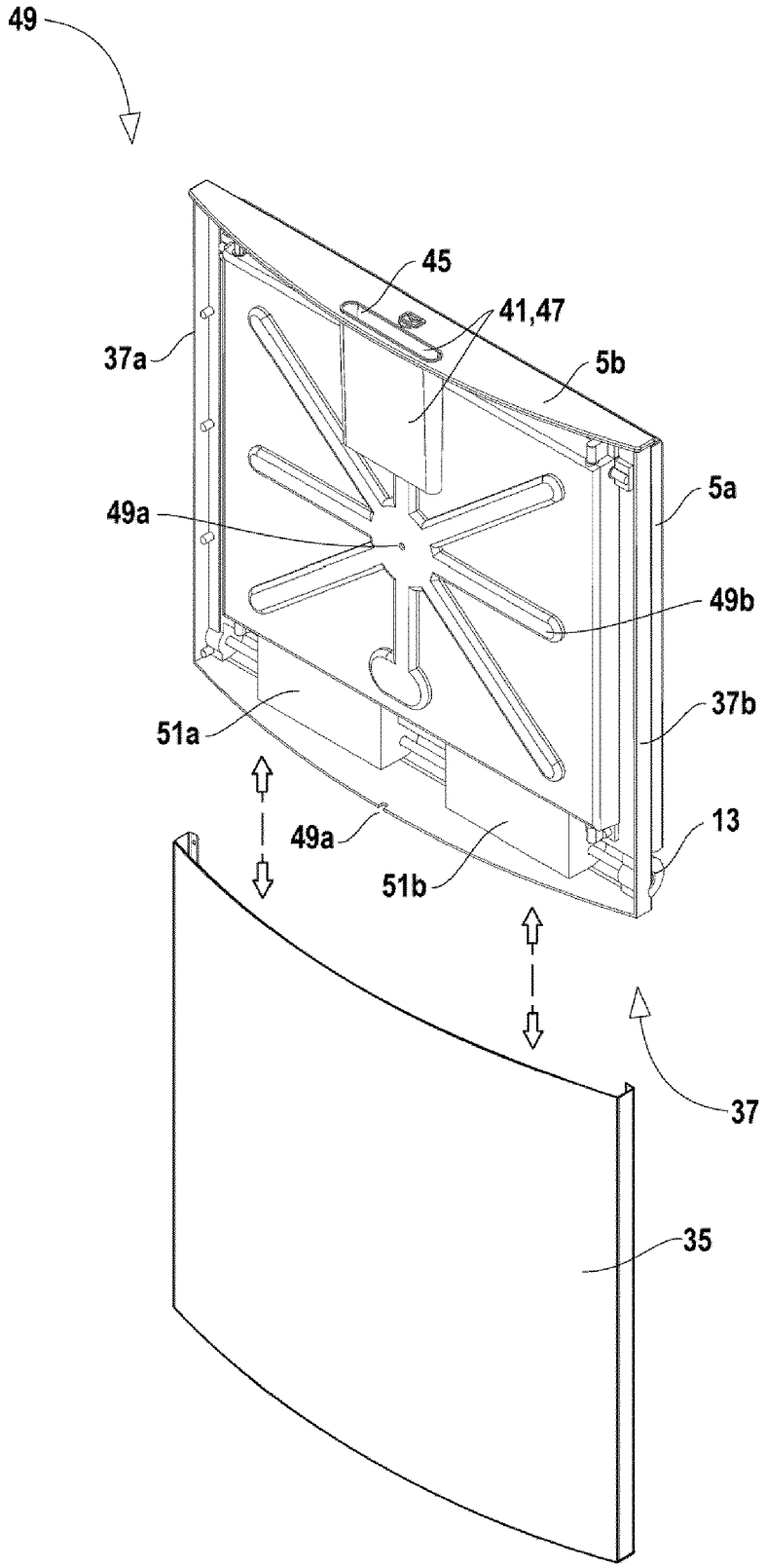
FIG. 21 is another front perspective view of the package receiving device of FIG. 7, the covering panel being shown removed from the bottom panel via a schematic representation to better illustrate a possible exploded relationship between said panels according to a possible embodiment of the present invention.
Figure 22:
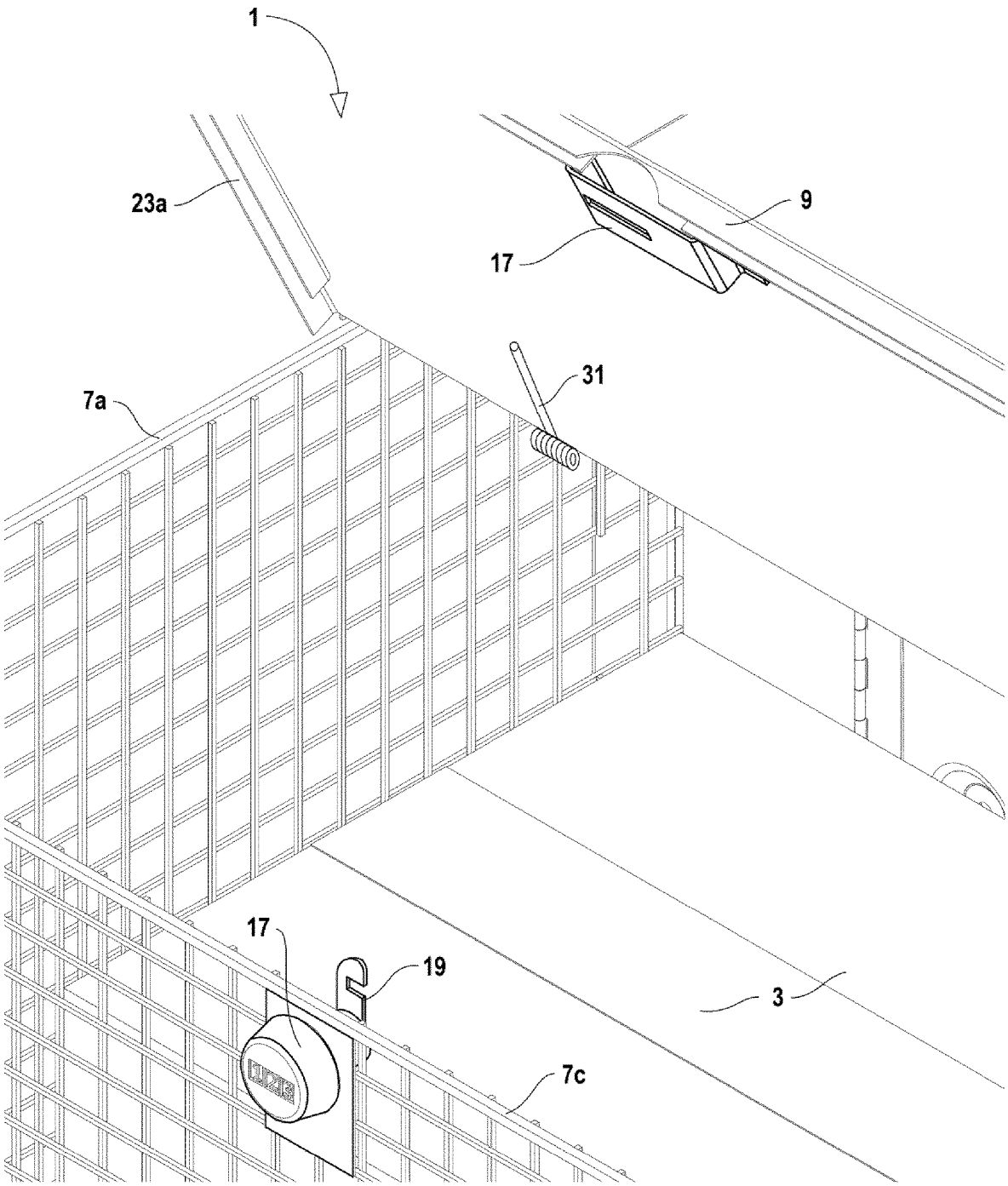
FIG. 22 is an enlarged view of a portion of the package receiving device shown in FIG. 18 to better illustrate a corresponding locking mechanism meant to interact between top panel(s) and an associated frontal panel according to a possible embodiment of the present invention.
Figure 23:
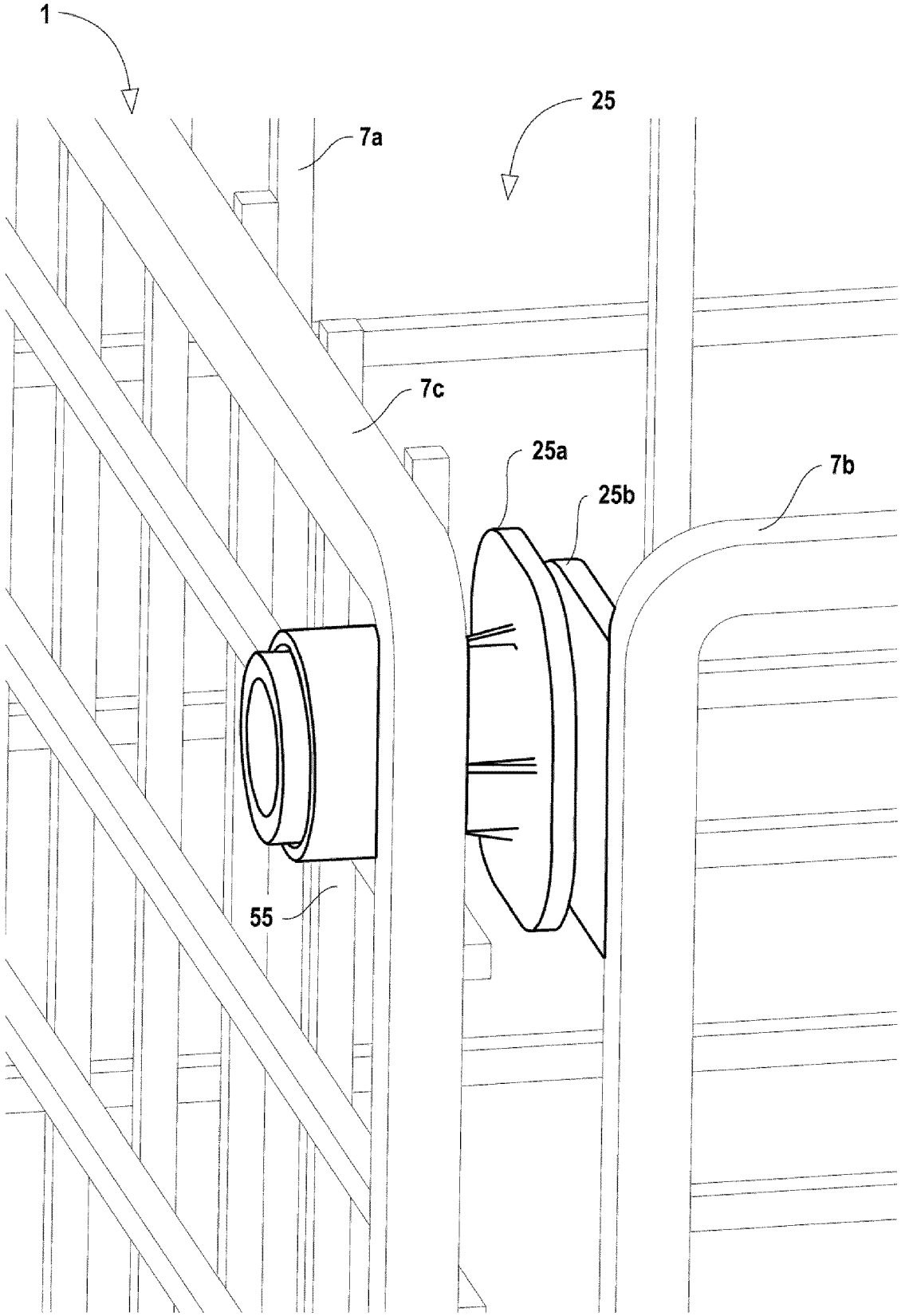
FIG. 23 is an enlarged view of another portion of the package receiving device shown in FIG. 18 to better illustrate a corresponding magnetic system meant to interact between adjacent side panels according to a possible embodiment of the present invention.

In the following description, the same numerical references refer to similar elements. Furthermore, for sake of simplicity and clarity, namely so as to not unduly burden the figures with several reference numbers, only some figures have been provided with reference numbers, and components and features of the present invention illustrated in other figures can be easily inferred therefrom. The embodiments, geometrical configurations, materials mentioned and/or dimensions shown in the figures are preferred, for exemplification purposes only.

Moreover, although the present invention was primarily designed for receiving (as well as delivering, expediting, etc.) and/or storing package(s), parcel(s), mail and/or the like, for example, it may be used with other objects and/or in other types of applications, as apparent to a person skilled in the art. For this reason, expressions such as "receiving", "delivering", "expediting", "storing", "package", "parcel", "mail", etc., used herein should not be taken so as to limit the scope of the present invention and include all other kinds of objects and/or applications with which the present invention could be used and may be useful. For example, the present package receiving device could also be used with and/or for various other "deliverable" and/or "receivable" products (ex. "publicity flyers", "promotional samples", etc.) for instance, as can be easily understood by a person skilled in the art.

Moreover, in the context of the present invention, the expressions "package receiving device", "device", "bin", "receptacle", "assembly", "system", "apparatus", "product", "unit", "equipment", "method" and "kit", as well as any other equivalent expression(s) and/or compound word(s) thereof known in the art will be used interchangeably, as apparent to a person skilled in the art. This applies also for any other mutually equivalent expressions, such as, for example: a) "delivering", "mailing", "expediting", "shipping", "distributing", "relaying", etc.; b) "receiving", "storing", "containing", "safekeeping", "protecting", "encasing", "shielding", etc.; c) "package", "parcel", "courier", "object", "item", "good", "mail", "letter", "publicity", "paper", "flier", "slip", "pamphlet", etc.; d) "collapsible", "collapsed", "folded", "closed", "shut", "non-deployed", etc.; e) "open", "deployed", "operational", "functional", etc.; f) "secured", "locked", "closed", etc.; g) "hole", "orifice", "through-hole", etc.; as well as for any other mutually equivalent expressions, pertaining to the aforementioned expressions and/or to any other structural and/or functional aspects of the present invention, as also apparent to a person skilled in the art. Also, in the context of the present description, expressions such as "can", "may", "might", "will", "could", "should", "would", etc., may also be used interchangeably, whenever appropriate, as also apparent to a person skilled in the art.

Furthermore, in the context of the present description, it will be considered that all elongated objects will have an implicit "longitudinal axis" or "centerline", such as the longitudinal axis of shaft for example, or the centerline of a coiled spring, for example, and that expressions such as "connected" and "connectable", or "mounted" and "mountable", may be interchangeable, in that the present invention also relates to a kit with corresponding components for assembling a resulting fully-assembled and fully-operational package receiving device.

Moreover, components of the present system(s) and/or steps of the method(s) described herein could be modified, simplified, altered, omitted and/or interchanged, without departing from the scope of the present invention, depending on the particular application(s) which the present invention is intended for, and the desired end result(s), as briefly exemplified herein and as also apparent to a person skilled in the art.

In addition, although the preferred embodiments of the present invention as illustrated in the accompanying drawings comprise various components, and although the preferred embodiments of the present package receiving device and corresponding portion(s)/part(s)/component(s) as shown consist of certain geometrical configurations, as explained and illustrated herein, not all of these components and geometries are essential to the invention and thus should not be taken in their restrictive sense, i.e. should not be taken so as to limit the scope of the present invention. It is to be understood, as also apparent to a person skilled in the art, that other suitable components and cooperation there in between, as well as other suitable geometrical configurations may be used for the present package receiving device and corresponding portion(s)/part(s)/component(s) according to the present invention, as will be briefly explained herein and as can be easily inferred here from by a person skilled in the art, without departing from the scope of the present invention.

LIST OF NUMERICAL REFERENCES FOR SOME OF THE CORRESPONDING POSSIBLE COMPONENTS ILLUSTRATED IN THE ACCOMPANYING DRAWINGS

1. package receiving device (or simply "device")
2. fixed structure
2*a*. railing
2*b*. wall
3. package
5. panel(s) (i.e. "outer" panel(s) of the package receiving device)
5*a*. mounting panel
5*b*. bottom panel (also acting as "covering panel" on outermost side)
7. side panel(s) (i.e. "inner" panel(s) of the package receiving device)
7*a*. first side panel (ex. "left lateral panel")
7*b*. second side panel (ex. "right lateral panel")
7*c*. third side panel (ex. "frontal panel" or simply "front panel")
9. top panel(s) (ex. lid(s))
9*a*. first top panel
9*b*. second top panel
11. mounting component (ex. bracket, fastener(s), etc.)
13. hinge
15. dampening system
15*a*. first dampening system (ex. "left dampening system")
15*b*. second dampening system (ex. "right dampening system")
17. locking mechanism
19. latch
21. retaining component
23. groove
23*a*. first groove (ex. "left groove")
23*b*. second groove (ex. "right groove")
23*c*. third groove (ex. "front groove")
25. magnetic retainment system
25*a*. magnet
25*b*. docking plate (ex. metal docking plate)
27. set of information and/or instructions (for user)
29. user identification code (ex. bar code)
31. spring (ex. radial spring, torsional spring, etc.)
33. fingerguard
33*a*. first fingerguard (ex. "left fingerguard")
33*b*. second fingerguard (ex. "right fingerguard")
35. covering panel (ex. "outer layer" or "skin" of package receiving device)
37. track (for covering panel)
37*a*. first track (ex. "left track")
37*b*. second track (ex. "right track")
39. rounded edge
39*a*. first rounded edge (ex. "top rounded edge")
39*b*. second rounded edge (ex. "bottom rounded edge")
41. slot (ex. for receiving mail, etc.)
43. symbol (for slot)
45. pulling component
47. recess
49. drainage system
49*a*. drainage hole (of drainage system)
49*b*. draining channel (of drainage system)
51. light emitting device (ex. LED)
51*a*. first light emitting device (ex. "left light emitting device")
51*b*. second light emitting device (ex. "right light emitting device")
53. railing component
55. other component
I. spanning width (of bottom and mounting panels)

Broadly described, and as better exemplified in the accompanying drawings, the present invention relates to a package receiving device (1) capable of easily, conveniently and securely containing a package being delivered therein (and/or meant to be expedited therefrom), until an intended recipient may decide to retrieve it via a corresponding key and/or unlocking mechanism associated to said package receiving device (1).

The present parcel receiving device (1) may come in the form of a package receiving device (1) including one and/or several of the following possible components and features (and/or different possible combination(s) and/or permutation (s) thereof):

Indeed, and as can be easily understood when referring to the accompanying drawings, there is provided a package receiving device (1) for receiving (and/or expediting) a package. The package receiving device may comprise a mounting panel for securely mounting the package receiving device onto a given fixed structure (ex. wall, railing, floor, etc.). The package receiving device may also comprise a bottom panel being operatively connectable to the mounting panel and being moveable with respect to said mounting panel. The package receiving device may also comprise at least side panel being operatively connectable to the bottom panel and being moveable with respect to said bottom panel. As exemplified in the accompanying drawings, the package receiving device and corresponding panels thereof may be operable between at least one first configuration where the mounting, bottom and side panels are collapsed onto one another into a reduced space, with the at least one side panel being placeable between the bottom and mounting panels, and being containable within a spanning width defined by said bottom and mounting panels, the package receiving device and corresponding panels thereof being further operable into at least one second configuration where the panels are deployed and positioned with respect to one another in order to define a containment space being shaped and sized for containing the package therein.

The mounting panel may include at least one mounting component (ex. a mounting bracket, and associated hardware, such as bolt(s), rivet(s), fastener(s), etc.) for mounting (ex. either securely, fixedly, temporarily, adjustably, etc.) the package receiving device onto the given fixed structure (ex. wall, railing, floor, etc.).

According to a possible embodiment, the bottom panel is hingedly connectable (ex. operatively mounted, connected, movable, pivotable, rotatable, etc.) with respect to the mounting panel of the package receiving device for operation between a first configuration where the bottom panel is operatively urged against the mounting panel (for example, during a collapsed configuration of the package receiving device), and a second configuration where the bottom panel is drawn away (ex. frontwardly, etc.) from said mounting panel (for example, during a deployed configuration of the package receiving device).

The bottom panel may be drawn away from the mounting panel via a pivoting action by pulling downwardly on said bottom panel, and the bottom panel may be hingedly connectable (ex. operatively mounted, connected, movable, pivotable, rotatable, etc.) with respect to the mounting panel of the package receiving device via at least one corresponding hinge (ex. a linear tube hinge, and/or any other suitable mechanical equivalent(s), etc.).

The package receiving device may comprise at least one dampening system for dampening a movement of the bottom panel with respect to the mounting panel (for example, either when the bottom panel is opened and/or closed). For example, the at least one dampening system may include a first extremity operatively connectable to the mounting panel and a second extremity operatively connectable to the bottom panel. In the embodiment illustrated in the accompanying drawings, the at least one dampening system includes at least one pneumatic strut, although various other suitable mechanical equivalents are also contemplated by the present invention.

For example, each dampening system may include a dampening pulley/wire system, with a spring-loaded pulley (and/or spool) being operatively provided about the mounting panel, and a corresponding cable cooperating with the pulley having a distal end connected to a corresponding side of the bottom panel.

Either way, and according to a possible embodiment, the at least one dampening system includes first and second dampening systems disposed on left and right sides respectively of the package receiving device, for providing the package receiving device with greater structural and/or operational symmetry/stability.

As can be easily understood when referring to the accompanying drawings, the at least one side panel of the package receiving device may include at least one pair of side panels.

Each side panel may be hingedly connectable (ex. operatively mounted, connected, movable, pivotable, rotatable, etc.) with respect to the mounting panel of the package receiving device for operation between a first configuration where each side panel is operatively urged against the mounting panel (for example, during a collapsed configuration of the package receiving device), and a second configuration where each side panel is drawn away (ex. sideways, etc.) from said mounting panel (for example, during a deployed configuration of the package receiving device).

Each side panel may be drawn away from the mounting panel via a pivoting action by pulling laterally on said each side panel, and each side panel may be hingedly connectable (ex. operatively mounted, connected, movable, pivotable, rotatable, etc.) with respect to the mounting panel of the package receiving device via at least one corresponding hinge (ex. a piano hinge, and/or any other suitable mechanical equivalent(s), etc.).

Alternatively, and as exemplified in the accompanying drawings, each side panel is hingedly connectable (ex. operatively mounted, connected, movable, pivotable, rotatable, etc.) with respect to the bottom panel of the package receiving device for operation between a first configuration where each side panel is operatively urged against the bottom panel (for example, during a collapsed configuration of the package receiving device), and a second configuration where each side panel is drawn away (ex. upwardly, etc.) from said bottom panel (for example, during a deployed configuration of the package receiving device).

Each side panel may be drawn away from the bottom panel via a pivoting action by pulling upwardly on said each side panel, and according to the embodiment illustrated, each side panel may be hingedly connectable (ex. operatively mounted, connected, movable, pivotable, rotatable, etc.) with respect to the bottom panel of the package receiving device via at least one corresponding hinge (ex. a piano hinge, and/or any other suitable mechanical equivalent (s), etc.).

As can be easily understood when referring to the accompanying drawings, the at least one pair of side panels may include left and right lateral panels, and the at least one side panel may include at least one frontal panel.

According to one possible embodiment, the at least one frontal panel may be hingedly connectable (ex. operatively mounted, connected, movable, pivotable, rotatable, etc.) with respect to the bottom panel of the package receiving device for operation between a first configuration where the at least one frontal panel is operatively urged against the bottom panel (for example, during a collapsed configuration of the package receiving device), and a second configuration where the at least one frontal panel is drawn away (ex. upwardly) from said bottom panel (for example, during a deployed configuration of the package receiving device).

The at least one frontal panel may be drawn away from the bottom panel via a pivoting action by pulling upwardly on said at least one frontal panel, and the at least one frontal panel may be hingedly connectable (ex. operatively mounted, connected movable, pivotable, rotatable, etc.) with respect to the bottom panel of the package receiving device via at least one corresponding hinge (ex. a piano hinge, and/or any other suitable mechanical equivalent(s), etc.).

As can also be easily understood when referring to the accompanying drawings, the package receiving device may include at least one top panel.

According to a possible embodiment, the at least one top panel is hingedly connectable (ex. operatively mounted, connected movable, pivotable, rotatable, etc.) with respect to the mounting panel of the package receiving device for operation between a first configuration where the at least one top panel is operatively urged against the mounting panel (for example, during a collapsed configuration of the package receiving device), and a second configuration where the at least one top panel is drawn away (ex. upwardly and/or outwardly) from said mounting panel (for example, during a deployed configuration of the package receiving device).

The at least one top panel may be drawn away from the mounting panel via a pivoting action by pulling on said at least one top panel, and the at least one top panel may be hingedly connectable (ex. operatively mounted, connected movable, pivotable, rotatable, etc.) with respect to the mounting panel of the package receiving device via at least one corresponding hinge (ex. a piano hinge, and/or any other suitable mechanical equivalent(s), etc.).

The at least one top panel may be provided with a locking mechanism configured to interact with at least one corresponding side panel of the package receiving device when operated in the at least one second configuration, so as to selectively lock the at least one top panel and associated package receiving device in place, thereby preventing a non-authorized user of the package receiving device from accessing a package placed inside said package receiving device.

According to a possible embodiment, the locking mechanism is configured to interact between at least the at least one top panel and at least one first side panel (ex. the at least one frontal panel). The locking mechanism may be further configured to interact between the at least one top panel and at least one other side panel (ex. left and/or right lateral panels). Optionally also, the locking mechanism may be further configured to interact between the at least one top panel and both the left and right lateral panels.

The locking mechanism may come in various shapes and forms, but according to a possible embodiment, it includes a one-time latch so to be maintained in a locked configuration when activated, and the one-time latch may be configured to be opened with a corresponding key and/or by combination (mechanically or electronically controlled—whether directly and/or remotely) owned by an authorized user of the package receiving device (ex. owner of the package receiving device, etc.).

According to the embodiment illustrated in the accompanying drawings, the at least one top panel includes first and second top panels being hingedly connectable (ex. operatively mounted, connected, movable, pivotable, rotatable, etc.) to one another one via at least one corresponding hinge, and the at least one corresponding hinge is spring-loaded via at least one corresponding spring for being biased into a deployed configuration (for example, when the package receiving device is opened by pulling down on the bottom panel, etc.).

The at least one corresponding spring may include at least one radial spring, although various other suitable mechanical equivalents are also contemplated by the present invention.

The at least one top panel (including first and/or second top panels) may include at least one retaining component being positioned, shaped and sized for cooperating with at least one top portion of at least one associated side panel (ex. left and/or right lateral panel, and/or font panel, etc.) for maintaining said at least one associated side panel in place when the package receiving device is operated in the at least one second configuration (for example, during a deployed and closed-off configuration of the package receiving device).

The at least one retaining component may comprise at least one groove for receiving (ex. retaining, securing, maintaining, etc.) a portion of a top edge of the at least one associated side panel, and thus, maintaining said at least one associated side panel, securely in place, etc. For example, the at least one retaining component may comprise at least one lateral groove for receiving (ex. retaining, securing, maintaining in place, etc.) a portion of a top edge of a corresponding lateral/side panel. Preferably, the at least one retaining component comprises at least left and right lateral grooves for receiving (ex. retaining, securing, maintaining in place, etc.) portions of top edges of the left and right lateral panels respectively. Preferably also, the at least one retaining component may comprise at least one front groove for receiving (ex. retaining, securing, maintaining in place, etc.) a portion of a top edge of the at least one frontal panel.

As can be easily understood when referring to the accompanying drawings, the package receiving device may comprise a magnetic retainment system for retaining adjacent panels together when the package receiving device is operated into the at least one second configuration (and prior to closing the top panel(s) on the side panel(s), for example). The magnetic retainment system may include at least one corresponding magnet being provided about a first side panel, said at least one corresponding magnet being positioned, shaped and sized, and having a magnetic capability, for retaining threreagainst a second side panel adjacent to the first side panel, when said second side panel is deployed up against the first side panel. The at least one corresponding magnet may include a spring-loaded magnet, and more particularly, a spring-loaded ceramic magnet, although various other suitable mechanical equivalents are also contemplated by the present invention.

As also show in the accompanying drawings, the magnetic retainment system may also include at least one metal magnet docking plate, and the at least one corresponding magnet can be provided about the frontal panel of the package receiving device, for example, said at least one corresponding magnet being positioned, shaped and sized, and having a magnetic capability, for retaining threreagainst a corresponding lateral panel. As can be easily understood from the drawings, and according to a possible embodiment, the at least one corresponding magnet comprises a pair of such corresponding magnets, one being used for retaining threreagainst the left lateral panel, and another one being used for retaining threreagainst the right lateral panel, when the left and right lateral panels are deployed up against the frontal panel respectively.

According to a possible embodiment of the package receiving device, the panels are positioned, shaped and sized so that the at least one top panel is located between the bottom and mounting panels when the package receiving device is operated in the at least one first configuration (for example, during a collapsed or closed configuration of the package receiving device).

As can be easily understood from the accompanying drawings, the panels may be further positioned, shaped and sized so that the at least one top panel is located between the at least one side panel and the mounting panel when the package receiving device is operated in the at least one first configuration (for example, during a collapsed or closed configuration of the package receiving device).

Alternatively, the panels could be positioned, shaped and sized so that the at least one top panel be located between the lateral panels and the at least one frontal panel when the package receiving device is operated in the at least one first configuration (ex. in an initial collapsed configuration).

As exemplified in the accompanying drawings, the package receiving device may include a set of information and/or instructions for a user of said package receiving device (ex. for a delivery person delivering, and/or someone picking-up the package, etc.). The set of information and/or instructions may be provided on an inner side of at least one corresponding panel of the package receiving device, for example. According to a possible embodiment shown, the set of information and/or instructions is provided on an inner side and upper portion of the mounting panel of the package receiving device.

It is worth mentioning that the package receiving device may be provided with different types of information and/or instructions in order to assist a user of said package receiving device, with the operational steps thereof.

For example, each other panel (ex. left and/or right lateral panel, and/or front panel, etc.) may be provided with a sequential indicia for indicating to a user of the package receiving device a sequential deployment (and/or retraction) of said each other panel (ex. left and/or right lateral panel, and/or front panel, etc.).

The sequential indicia could include at least one corresponding number, for example, and in the case where the package receiving device comprises left and right lateral panels, and a front panel, the left and right lateral panels could be provided with sequential indicia "1" and "2" respectively (for example), and the front panel is provided with sequential indicia "3" (for example), although various other possible sequences of deployment are also contemplated by the present invention (ex. one could start with the front panel first, and then continue with either one of the left and right lateral panels, as exemplified in the accompanying figures).

Alternatively and instead of number(s), the sequential indicia could includes at least one corresponding letter, and in the case where the package receiving device comprises left and right lateral panels, and a front panel, and the left and right lateral panels could be provided with sequential indicia "A" and "B" respectively (for example), and the front panel could be provided with sequential indicia "C" (for example). Once again, various other possible sequences of deployment are also contemplated by the present invention (ex. one could start with the front panel first, and then continue with either one of the left and right lateral panels, as exemplified in the accompanying figures).

In either case, each corresponding sequential indicia could be either embossed and/or printed, and/or displayed via any other suitable manner, on its corresponding panel, etc.

It is worth mentioning however that such sequential indicia are not absolutely necessary, in that, the design of the present package receiving device allows a user to engage the deployment sequence in a very simplified, and very natural and very intuitive manner. Indeed, deployment/operation and positioning of the panels (ex left and right lateral panels, frontal panel, top panel(s), etc.) are meant to done very easily and instinctively, and a result, sequential indicia are not absolutely necessary on the panels(s), and the present package receiving could simply be provided with a very succinct set of information and/or instructions which, for example, could read as follows: 1) release spring-loaded folding lid; 2) lift all (3) flaps to open position; 3) place parcel inside receptacle; 4) close lid and lock; and 5) scan and/or take photo of unique client code below.

Indeed, as can be easily understood from the accompanying drawings and intended use of the present invention, the package receiving device may includes at least one user identification code associated to at least one user of said package receiving device, and to be used by at least one intervening person (ex. delivery person, pick-up person, etc.) during the delivery and/or expediting process. Indeed, it is worth mentioning that the present the package receiving device is not only intended to be used as a delivery device, but could also be used for expediting, in that, a user of the package receiving device could use it to expedite a package meant to be pick up by a shipping company and/or personnel that could be provided with authorized access to the package receiving device via a suitable manner (ex. a key, an access code, etc.).

As exemplified in the accompanying drawings, the user identification code could provided an inner side of at least one corresponding panel of the package receiving device (ex. on an inner side and upper portion of the mounting panel of the package receiving device), and could include a bar code, for example, although various other suitable location (s) on the package receiving device are also contemplated by the present invention for the user identification code, and various other suitable mechanical, electrical/electronical and/or other equivalents are also contemplated by the present invention for the type of user identification code and/or access code.

According to a possible embodiment, and as exemplified in the accompanying drawings, the at least one side panel may be a substantially rectangular side panel, in which case, the containment space defined by the panels when deployed and positioned with respect to one another into the at least one second configuration would correspond substantially to a rectangular prism, for example, although various other suitable shapes and forms are also contemplated by the present invention for the panel(s) (ex. whether left and/or right lateral panels, and/or frontal panel). It is also worth mentioning that the present package receiving device need not be limited to the presence of many such panel(s), and could ultimately be provided with one "single side panel" being positioned, shaped and sized to receive the package therein when in the deployed configuration. For example, such "single side panel" could ultimately be made of a deformable and resilient/elastic material, capable of being collapsed when the package receiving device is closed (i.e. collapsed), but also, capable of providing an appropriate containment contour wall for the package when the package receiving device is deployed. Naturally, other part(s) and/or panel(s) of the package receiving device could be modified and altered accordingly to accommodate such a "single side panel".

Similarly, whether it be a "single side panel" and/or a plurality of side panels (ex. left and right lateral panels, and a frontal panel, as exemplified in the accompanying drawings), each panel could come in a variety of different shapes, forms and sizes, depending on the intended use/purpose of the package receiving device, and the desired end result(s), as can be easily understood by a person skilled in the art. For example the at least one side panel may be made of and/or contain a portion made of a transparent material. Alternatively, the at least one side panel may be made of and/or contain a portion made of a translucid material. Optionally also, the at least one side panel may be made of and/or contain a portion made of an opaque material. In the embodiment illustrated in the accompanying drawings, each side panel (ex. left and/or right lateral panel, and/or front panel, etc.) is a meshed panel (ex. wire meshing, etc.).

As can be easily understood from the accompanying drawings, and according to a possible embodiment, each side panel (ex. top panel, and/or left and/or right lateral panel, and/or front panel, etc.) is spring-loaded via at least one corresponding spring for being biased into a deployed configuration.

The at least one corresponding spring may include a radial and/or torsional spring, although various other suitable mechanical equivalents are also contemplated by the present invention.

As also shown, the package receiving device may comprise at least one side fingerguard for laterally covering a side portion of the containment space when the package receiving device is operated into the at least one second configuration (for example, during a deployed configuration of the package receiving device).

According to one possible embodiment, the at least one side fingerguard may be hingedly connectable with respect to the mounting panel of the package receiving device for operation between a first configuration where the at least one side fingerguard is operatively urged against the mounting panel, and a second configuration where at least one side fingerguard is drawn away from said mounting panel.

The at least one side fingerguard may be drawn away from the mounting panel via a pivoting action by pulling laterally on said at least one side fingerguard, and according to a possible embodiment, the at least one side fingerguard is spring-loaded via at least one corresponding spring for being biased into a deployed configuration, and the at least one corresponding spring may include a radial spring, for example, although various other suitable mechanical equivalents are also contemplated by the present invention.

According to the embodiment exemplified in the accompanying drawings, the package receiving device comprises at least one pair of side fingerguards (ex. left and right side fingerguards) for laterally covering left and right side portions respectively of the containment space when the package receiving device is operated into the at least one second configuration (for example, during a deployed configuration of the package receiving device).

Optionally, and although not shown, each side fingerguard could be positioned, shaped and sized so as to be insertable into a corresponding recess defined about an inner portion of the bottom panel when the package receiving device is operated into the at least one first configuration (for example, during a collapsed configuration of the package receiving device).

As also exemplified in the accompanying drawings, the package receiving device may include at least one covering panel being positioned, shaped and sized for covering (ex. concealing, hiding, etc.) the panels of the package receiving device when operated in the at least one first configuration (for example, during a collapsed or closed configuration of the package receiving device).

The covering panel may be a separate piece from the bottom panel, or could ultimately be made to be integral to said bottom panel, in which case, the covering and bottom panel would represent a single piece made of essentially a same material, in which case, the at least one covering panel would be positioned, shaped and sized for acting as the at least one bottom wall when the package receiving device is operated in the at least one second configuration (for example, during a deployed or operational configuration of the package receiving device).

According to a possible embodiment, and as exemplified in the accompanying drawings, the at least one covering panel is mountable onto an outermost side of the bottom panel, and may be slidably mountable onto at least one corresponding track of the outermost side of the bottom panel, and preferably, onto a pair of distally-apart tracks provided on a corresponding pair of distally-apart side edges of the bottom panel.

The at least one covering panel may include at least one rounded edge, and preferably, the at least one covering panel includes a pair of distally-apart rounded side edges, in order to provide the covering panel with a very slim and slick overall design.

As can be easily understood, components of the package receiving device and/or the at least one covering panel are made of a durable weather resistant material, and components of the package receiving device and/or the at least one covering panel may also be protected with a weather resistant layer (ex. spray, coating, film, paint, etc.).

The at least one covering panel may also be provided with an outer layer (ex. skin, etc.) made similar and/or identical to a surrounding environment (ex. bricks of a wall of a home, aluminum siding, etc.) of the package receiving device, in order for the at least one covering panel (and thus, for the overall package receiving device) to "blend in" nicely with its surrounding environment, etc.

As also exemplified in the accompanying drawings, the package receiving device can include a slot for receiving mail therethrough. According to a possible embodiment, and as shown in the figures, the slot for receiving mail may be provided with an adjacent symbol, being representative of mail, for indicating to user of the package receiving device an intended use of said slot. For example, and as shown in the figures, a symbol of an "envelope" and a corresponding directional "arrow" could be provided adjacent to the slot. The slot may be provided about an upper portion of the package receiving device when operated in the at least one first configuration, and preferably, the slot is operatively provided about the bottom panel of the package receiving device, so as to be easily visible and exposed about an upper portion of the package receiving device when operated in the at least one first configuration (for example, during a collapsed or closed configuration of the package receiving device). Thus, and as can be easily understood from the accompanying drawings, the present package device, by virtue of its design and components, could also be used as a conventional mailbox.

As also exemplified in the accompanying drawings, the package receiving device may includes a pulling component, and the pulling component may be a corresponding recess integrated about a corresponding panel of the package receiving device. According to an advantageous embodiment, the pulling component is operatively provided about the bottom panel of the package receiving device, and preferably also, the pulling component is operatively defined by the slot of the bottom panel of the package receiving device, although various other suitable mechanical equivalents and/or locations are also contemplated by the present invention for the mailing slot and/or pulling component.

As way of example and depending on the specific nature/construction of the bottom/covering panel assembly, the slot and/or pulling component could provided about a top portion of the at least one covering panel, for example. Alternatively also, the pulling component could be some sort of embossed and/or protruding pulling component.

As can be easily understood when referring to the accompanying drawings, the package receiving device may includes a drainage system for draining liquid (ex. rain, melted snow, etc.) accumulated in the containment space. As exemplified in the drawings, the drainage system may include at least one component selected from the group consisting of draining hole and drainage channel, and according to the embodiment exemplified in the drawings, the drainage system is provided about an inner side of the bottom panel, and includes at least one centralized drainage hole and a series of converging drainage channels, although various other suitable mechanical equivalents and/or dispositions are also contemplated by the present invention for the drainage system.

As also exemplified in the accompanying drawings, the package receiving device may include at least one light emitting device, which may be provided about a lower portion of the package receiving device, for example, when operated in the at least one first configuration. According to a possible embodiment, the at least one light emitting device is operatively provided about the bottom panel of the package receiving device. Alternatively and depending on the specific nature/construction of the bottom/covering panel assembly, the at least one light emitting device could be located about a bottom portion of the at least one covering panel of the package receiving device.

Either way, and according to a possible embodiment, the at least one light emitting device can include a dusk sensor and may be operable during low-light conditions (ex. at dusk, night, etc.). As can be easily understood, the at least one light emitting device may be connected (and/or operatively connectable, etc.) to a source of energy (ex. electrical wiring, battery pack, solar panel, etc.) for proper operation.

The at least one light emitting device may includes at least one light emitting diode (LED), for example, although other suitable lighting equivalents are also contemplated by the present invention for the at least one light emitting device, and according to a possible embodiment, and as exemplified in the accompanying figures, the at least one light emitting device includes a pair of light emitting devices, each being disposed about a corresponding side of the package receiving device.

Optionally, the package receiving device is commercialized under a given trademark name, and the given trademark name may be present on the at least one covering panel so as to be visible when the package receiving device is operated in the at least one first configuration (ex. a collapsed configuration). The given trademark name may be embossed and/or engraved on the at least one covering panel, for example, although other suitable ways of displaying are also contemplated by the present invention for the given trademark name. According to one possible embodiment, the package receiving device is commercialized under the trademark name of Pelican™, which is one possible trademark name contemplated by the Applicant/Assignee of the present case.

According to a possible embodiment, and as can be easily understood when referring to the accompanying drawings, components of the package receiving device can be made to be modular and/or interchangeable according to specific needs of user(s) of the package receiving device.

According to another aspect of the present invention, there is provided also a kit with corresponding components for assembling a package receiving device according to described and/or illustrated in the present patent specification. The package receiving device may also comprise a mounting component (and/or kit) for mounting (ex. either securely, fixedly, temporarily, adjustably, etc.) the package receiving device (and/or corresponding components thereof) onto a given structure (ex. wall, railing, floor, etc.). Namely, the package receiving device may also comprise corresponding railing component(s) (ex. bar(s), and associated hardware, such as bolt(s), rivet(s), fastener(s), etc.), for installing the package receiving device onto a corresponding railing, for example.

Other possible aspect(s), object(s), embodiment(s), variant(s), and/or resulting advantage(s) of the present package receiving device (1), all being preferred and/or optional, are briefly explained hereinbelow, and can be easily understood and/or inferred from the accompanying drawings, as well.

Namely, several modification(s), alteration(s), addition(s) and/or simplification(s) could be made to the present package receiving device (1), depending on the intended purpose (s) and/or desired result(s), without departing from the scope of the present invention, as can be easily understood by a person skilled in the art.

For example, each side panel (ex. left and/or right lateral panel, and/or front panel, etc.), whether it be full, opaque, transparent, translucid and/or transparent, could provided with a corresponding orifice (ex. for aeration, manipulating, visual inspection, etc.). This corresponding orifice could come in various shapes and sizes, but according to a possible embodiment, each orifice could be substantially circular, could be disposed in a substantially centralized area of a respective panel, and could also act as a a finger-port hole, for example.

Furthermore, instead of the aforementioned fingerguard (s), the package receiving device could be provided with at least one side flange for laterally covering the at least one side panel (ex. left and/or right lateral panel(s)) when the package receiving device is operated in the at least one first configuration (for example, during a collapsed or closed configuration of the package receiving device). According to a possible embodiment, the package receiving device could include at least one pair of side flanges (ex. left and right side flanges) for laterally covering left and right side portions respectively of the at least one side panel (ex. left and right lateral panels) when the package receiving device is operated into the at least one first configuration (for example, during a collapsed or closed configuration of the package receiving device), and the left and right lateral panels could be hingedly connectable (ex. operatively mounted, connected movable, pivotable, rotatable, etc.) to the left and right side flanges respectively of the package receiving device, for example. Similarly to the above-discussed, each side flange (ex. left and/or right side flange) could also be provided with a corresponding orifice (ex. for aeration, manipulating, visual inspection, etc.).

As may now be better appreciated, the present package receiving device (1) is a considerable improvement over conventional ways of delivering and receiving packages, parcels and the like, in that it overcomes the many drawbacks and inconveniences associated with such ways. Indeed, the present system enables a package to be delivered at a given destination, easily, safely and conveniently, in that the package is considerably much less exposed to theft and/or weather-damage when contained and secured inside the package receiving device, and the intended recipient need not miss work and/or school, or even have to waste time, energy and/or effort having to deal with delivery companies, or even having to go pick up the package at an alternate location, because it is left securely in the package receiving device (1), that he/she may open, at his/her convenience, using a corresponding key and/or other suitable unlocking mechanism associated to said package receiving device (1), etc.

As may also be better appreciated, the present package receiving device (1) is also a considerable improvement over conventional devices for various other different reasons. For example, the present receiving device (1) offers a very clean and compact configuration when operated into the at least first configuration (i.e. during a collapsed or closed configuration of the package receiving device). Indeed, the outermost side of the bottom panel (i.e. the covering panel) is the only most prevalent component that can be seen of the package receiving device, and all other remaining components (i.e. left and right lateral panels, frontal panel, top panel(s), locking mechanism, etc.) are not only completely concealed by the outermost side of the bottom panel (i.e. the covering panel), but also, are completely contained and protected between said bottom panel and the mounting panel. Furthermore, the curved configuration of the outermost side of the bottom panel (i.e. the covering panel), along with tapered left and right distal edges, provides the package receiving device with a very slim look. Furthermore, and as explained above, given that the covering panel can be provided with an outer layer (ex. skin, etc.) made similar and/or identical to a surrounding environment (ex. bricks of a wall of a home, aluminum siding, etc.) of the package receiving device, the latter offers a very discreet and unobtrusive package receiving device, something that is not possible with other conventional devices. The present package receiving device is also advantageous in that it provides a user for a simplified, and very natural and very intuitive use. Indeed, when exposed to the package receiving device in the collapsed (or closed) configuration, the user will instinctively be drawn to the slot which, as explained above and according to a possible embodiment, is situated on an upper portion of the bottom panel, lending itself to a very simple pulling action downwardly, and the remaining components of the package receiving device are then deployed biasedly via corresponding spring(s) and/or further naturally and intuitively by the user due to the design, operation and the positioning of the panels (ex left and right lateral panels, frontal panel, top panel(s), etc.) which are meant to be easily disposed with respect to one another in order to define the containment space (in the embodiment shown in the accompanying figures, having a geometry corresponding to that of a rectangular prism, which is generally complementary to that of most packages, further directing the user into a very simple, nature and intuitive operation of the panels, etc.). This is further assisted by the presence of retaining component(s) operating between top panel(s) and associated side panel(s) (ex. left and/or right lateral panel, and/or font panel, etc.), and/or by magnet(s) operating between corresponding adjacent side panels, that contribute to assist in positioning and maintaining the various panels of the package receiving device in place. The present package receiving device (1) is also very advantageous with respect to other conventional devices, in that, it is symmetrical, and operated in a very centralized manner (ex. all panels and contained and operated within a spanning width defined by the bottom and mounting panels), for an easier and more compact use of the product, etc.

The present package receiving device (1) and corresponding parts are preferably made of substantially rigid materials, such as metallic materials, hardened polymers, composite materials, polymeric materials, and/or the like, so as to ensure a proper operation thereof depending on the particular applications for which the package receiving device (1) is intended and the different parameters (weights, loads, moments, etc.) in cause, as apparent to a person skilled in the art.

Of course, and as can be easily understood by a person skilled in the art, the scope of the claims should not be limited by the possible embodiments set forth in the examples, but should be given the broadest interpretation consistent with the description as a whole.

Furthermore, although preferred embodiments of the present invention have been briefly described herein and illustrated in the accompanying drawings, it is to be understood that the invention is not limited to these embodiments and that various changes and modifications could be made without departing form the scope and spirit of the present invention, as defined in the appended claims and as apparent to a person skilled in the art.

The invention claimed is:

1. A package receiving device for receiving a package, the package receiving device comprising:

a mounting panel for securely mounting the package receiving device onto a given fixed structure;

a bottom panel being operatively connectable to the mounting panel and being moveable with respect to said mounting panel; and at least one side panel being operatively connectable to the bottom panel and being moveable with respect to said bottom panel;

the package receiving device and the panels thereof being operable between at least one first configuration where the mounting, bottom and side panels are collapsed onto one another into a reduced space, with the at least one side panel being placeable between the bottom and mounting panels, and being containable within a spanning width defined by said bottom and mounting panels, the package receiving device and the thereof being further operable into at least one second configuration where the panels are deployed and positioned with respect to one another in order to define a containment space being shaped and sized for containing the package therein;

wherein the at least side panel includes at least one pair of side panels;

wherein each side panel is hingedly movable with respect to the mounting panel of the package receiving device for operation between a first configuration where each side panel is operatively urged against the mounting panel, and a second configuration where each side panel is drawn away from said mounting panel;

wherein each side panel is drawn away from the mounting panel via a pivoting action by pulling laterally on said each side panel;

wherein each side panel is hingedly movable with respect to the mounting panel of the package receiving device via at least one corresponding hinge;

wherein each side panel is hingedly movable with respect to the bottom panel of the package receiving device for operation between a first configuration where each side panel is operatively urged against the bottom panel, and a second configuration where each side panel is drawn away from said bottom panel;

wherein each side panel is drawn away from the bottom panel via a pivoting action by pulling upwardly on said each side panel;

wherein each side panel is hingedly movable with respect to the bottom panel of the package receiving device via at least one corresponding hinge;

wherein the at least one pair of side panels includes left and right lateral panels; wherein the at least side panel includes at least one frontal panel;

wherein the at least one frontal panel is hingedly movable with respect to the bottom panel of the package receiving device for operation between a first configuration where the at least one frontal panel is operatively urged against the bottom panel, and a second configuration where the at least one frontal panel is drawn away from said bottom panel;

wherein the at least one frontal panel is drawn away from the bottom panel via a pivoting action by pulling upwardly on said at least one frontal panel; and wherein the at least one frontal panel is hingedly movable with respect to the bottom panel of the package receiving device via at least one corresponding hinge.

2. A package receiving device according to claim 1, wherein the mounting panel includes at least one mounting component for mounting the package receiving device onto the given fixed structure.

3. A package receiving device according to claim 1, wherein the bottom panel is hingedly movable with respect to the mounting panel of the package receiving device for operation between a first configuration where the bottom panel is operatively urged against the mounting panel, and a second configuration where the bottom panel is drawn away from said mounting panel;

wherein the bottom panel is drawn away from the mounting panel via a pivoting action by pulling downwardly on said bottom panel; and wherein the bottom panel is hingedly movable with respect to the mounting panel of the package receiving device via at least one corresponding hinge.

4. A package receiving device according to claim 1, wherein the package receiving device comprises at least one dampening system for dampening a movement of the bottom panel with respect to the mounting panel;

wherein the at least one dampening system including a first extremity operatively connectable to the mounting panel and a second extremity operatively connectable to the bottom panel; and wherein the at least one dampening system includes first and second dampening systems disposed on left and right sides respectively of the package receiving device.

5. A package receiving device according to claim 1, wherein the package receiving device includes at least one top panel;

wherein the at least one top panel is hingedly movable with respect to the mounting panel of the package receiving device for operation between a first configuration where the at least one top panel is operatively urged against the mounting panel, and a second configuration where the at least one top panel is drawn away from said mounting panel;

wherein the at least one top panel is drawn away from the mounting panel via a pivoting action by pulling on said at least one top panel; and wherein the at least one top panel is hingedly movable with respect to the mounting panel of the package receiving device via at least one corresponding hinge.

6. A package receiving device according to claim 5, wherein the at least one top panel is provided with a locking mechanism configured to interact with at least one corresponding side panel of the package receiving device when operated in the at least one second configuration, so as to selectively lock the at least one top panel in place, thereby preventing a non-authorized user of the package receiving device from accessing a package placed inside said package receiving device the packaging receiving device further having at least one of the following components and features:

wherein the locking mechanism is configured to interact between at least the at least one top panel and at least one first side panel;

wherein the locking mechanism is further configured to interact between the at least one top panel and at least one other side panel;

wherein the locking mechanism is further configured to interact between the at least one top panel and both left and right lateral panels;

wherein the locking mechanism includes a one-time latch so to be maintained in a locked configuration when activated; and wherein the one-time latch is configured to be opened with a corresponding key or combination owned by an authorized user of the package receiving device.

7. A package receiving device according to claim 5, wherein the at least one top panel includes first and second top panels being hingedly connectable to one another one, the packaging receiving device further having at least one of the following components and features:

wherein the first and second top panels are hingedly connectable to one another one via at least one corresponding hinge; and wherein the at least one corresponding hinge is spring-loaded via at least one corresponding spring for being biased into a deployed configuration.

8. A package receiving device according to claim 5, wherein the at least one top panel includes at least one retaining component being positioned, shaped and sized for cooperating with at least one top portion of at least one associated side panel for maintaining said at least one associated side panel in place when the package receiving device is operated in the at least one second configuration, the packaging receiving device further having at least one of the following components and features:

wherein the at least one retaining component comprises at least one groove for receiving a portion of a top edge of the at least one associated side panel;

wherein the at least one retaining component comprises at least one lateral groove for receiving a portion of a top edge of a corresponding side panel;

wherein the at least one retaining component comprises at least left and right lateral grooves for receiving portions of top edges of left and right lateral panels respectively; and wherein the at least one retaining component comprises at least one front groove for receiving a portion of a top edge of at least one frontal panel.

9. A package receiving device according to claim 5, wherein the panels are positioned, shaped and sized so that the at least one top panel is located between the bottom and mounting panels when the package receiving device is operated in the at least one first configuration, and wherein the panels are further positioned, shaped and sized so that the at least one top panel is located between the at least one side panel and the mounting panel when the package receiving device is operated in the at least one first configuration.

10. A package receiving device according to claim 1, wherein the package receiving device comprises a magnetic retainment system for retaining adjacent panels together when the package receiving device is operated into the at least one second configuration, the packaging receiving device further having at least one of the following components and features:

wherein the magnetic retainment system includes at least one corresponding magnet being provided about a first side panel, said at least one corresponding magnet being positioned, shaped and sized, and having a magnetic capability, for retaining thereagainst a second side panel adjacent to the first side panel, when said second side panel is deployed up against the first side panel;

wherein the at least one corresponding magnet includes a spring-loaded magnet;

wherein the spring-loaded magnet is a spring-loaded ceramic magnet;

wherein the magnetic retainment system includes at least one metal magnet docking plate;

wherein the at least one corresponding magnet is provided about a frontal panel of the package receiving device, said at least one corresponding magnet being positioned, shaped and sized, and having a magnetic capability, for retaining thereagainst a corresponding lateral panel; and wherein the at least one corresponding magnet comprises a pair of such corresponding magnets, one being used for retaining thereagainst a left lateral panel, and another one being used for retaining thereagainst a right lateral panel, when the left and right lateral panels are deployed up against the frontal panel respectively.

11. A package receiving device according to claim 1, the packaging receiving device further having at least one of the following components and features:

wherein the package receiving device includes a set of information and/or instructions for a user of said package receiving device;

wherein the set of information and/or instructions is provided an inner side of at least one corresponding panel of the package receiving device;

wherein the set of information and/or instructions is provided an inner side and upper portion of the mounting panel of the package receiving device;

wherein the package receiving device includes a user identification code associated to a user of said package receiving device;

wherein the user identification code is provided an inner side of at least one corresponding panel of the package receiving device;

wherein the user identification code is provided an inner side and upper portion of the mounting panel of the package receiving device;

wherein the user identification code includes a bar code;

wherein the at least one side panel is a substantially rectangular side panel;

wherein the containment space defined by the panels when deployed and positioned with respect to one another into the at least one second configuration correspond substantially to a rectangular prism;

wherein the at least one side panel is made of a transparent material;

wherein the at least one side panel is made of a translucid material;

wherein the at least one side panel is made of an opaque material; and wherein the at least one side panel is a meshed panel.

12. A package receiving device according to claim 1, wherein the at least one side panel is spring-loaded via at least one corresponding spring for being biased into the at least one second configurations, and wherein the at least one corresponding spring includes a spring selected from the group consisting of a radial spring and a torsional spring.

13. A package receiving device according to claim 1, wherein the package receiving device comprises at least one side fingerguard for laterally covering a side portion of the containment space when the package receiving device is operated into the at least one second configuration, the packaging receiving device further having at least one of the following components and features:

wherein the at least one side fingerguard is hingedly connectable with respect to the mounting panel of the package receiving device for operation between a first configuration where the at least one side fingerguard is operatively urged against the mounting panel, and a second configuration where at least one side fingerguard is drawn away from said mounting panel;

wherein the at least one side fingerguard is drawn away from the mounting panel via a pivoting action by pulling laterally on said at least one side fingerguard;

wherein the at least one side fingerguard is spring-loaded via at least one corresponding spring for being biased into a deployed configuration; and wherein the package receiving device comprises at least one pair of side fingerguards for laterally covering left and right-side portions respectively of the containment space when the package receiving device is operated into the at least one second configuration.

14. A package receiving device according to claim 1, wherein the package receiving device includes at least one covering panel being positioned, shaped and sized for covering the panels of the package receiving device when operated in the at least one first configuration, the packaging receiving device further having at least one of the following components and features:

wherein the at least one covering panel is mountable onto an outermost side of the bottom panel;

wherein the at least one covering panel is slidably mountable onto a corresponding track of the outermost side of the bottom panel;

wherein the at least one covering panel includes at least one rounded edge;

wherein the at least one covering panel includes a pair of distally-apart rounded side edges;

wherein the at least one covering panel is provided with an outer layer made similar to a surrounding environment of the package receiving device; and wherein components of the package receiving device are made of a weather resistant material;

wherein components of the package receiving device are protected with a weather resistant layer.

15. A package receiving device according to claim 1, wherein the package receiving device includes a slot for receiving mail therethrough, the packaging receiving device further having at least one of the following components and features:

wherein the slot for receiving mail is provided with an adjacent symbol being representative of mail for indicating to user of the package receiving device an intended use of said slot;

wherein the slot is provided about an upper portion of the package receiving device when operated in the at least one first configuration; and wherein the slot is operatively provided about the bottom panel of the package receiving device.

16. A package receiving device according to claim 1, wherein the package receiving device includes a pulling component, the packaging receiving device further having at least one of the following components and features:

wherein the pulling component includes a corresponding recess integrated about a corresponding panel of the package receiving device;

wherein the pulling component is operatively provided about the bottom panel of the package receiving device; and wherein the pulling component is operatively defined by slot of the bottom panel of the package receiving device.

17. A package receiving device according to claim 1, wherein the package receiving device includes a drainage system for draining liquid accumulated in the containment space;

wherein the drainage system includes at least one component selected from the group consisting of draining hole and drainage channel;

wherein the drainage system is provided about an inner side of the bottom panel; and wherein the inner side of the bottom panel is provided with at least one centralized drainage hole and a series of converging drainage channels.

18. A package receiving device according to claim 1, wherein the package receiving device includes at least one light emitting device, the packaging receiving device further having at least one of the following components and features:

wherein the at least one light emitting device is provided about a lower portion of the package receiving device when operated in the at least one first configuration;

wherein the at least one light emitting device is operatively provided about the bottom panel of the package receiving device;

wherein the at least one light emitting device includes a dusk sensor and is operable during low-light conditions;

wherein the at least one light emitting device is operatively connectable to a source of energy;

wherein the at least one light emitting device includes at least one light emitting diode (LED);

wherein the at least one light emitting device includes a pair of light emitting devices, each being disposed about a corresponding side of the package receiving device;

wherein the package receiving device is commercialized under a given trademark name, and wherein the given trademark name is present on the at least one covering panel so as to be visible when the package receiving device is operated in the at least one first configuration; and wherein the package receiving device comprises at least one railing component for installing the package receiving device onto a corresponding railing.

19. A kit for assembling the package receiving device according to claim 1, the kit comprising: corresponding components.

20. A package receiving device for receiving a package, the package receiving device comprising:

a mounting panel for securely mounting the package receiving device onto a given fixed structure;

a bottom panel being operatively connectable to the mounting panel and being moveable with respect to said mounting panel; and at least one side panel being operatively connectable to the bottom panel and being moveable with respect to said bottom panel;

the package receiving device and the panels thereof being operable between at least one first configuration where the mounting, bottom and side panels are collapsed onto one another into a reduced space, with the at least one side panel being placeable between the bottom and mounting panels, and being containable within a spanning width defined by said bottom and mounting panels, the package receiving device and the thereof being further operable into at least one second configuration where the panels are deployed and positioned with respect to one another in order to define a containment space being shaped and sized for containing the package therein;

wherein the at least one top panel is provided with a locking mechanism configured to interact with at least one corresponding side panel of the package receiving device when operated in the at least one second configuration, so as to selectively lock the at least one top panel in place, thereby preventing a non-authorized user of the package receiving device from accessing a package placed inside said package receiving device the packaging receiving device further having at least one of the following components and features:

wherein the locking mechanism is configured to interact between at least the at least one top panel and at least one first side panel;

wherein the locking mechanism is further configured to interact between the at least one top panel and at least one other side panel; wherein the locking mechanism is further configured to interact between the at least one top panel and both left and right lateral panels;

wherein the locking mechanism includes a one-time latch so to be maintained in a locked configuration when activated; and wherein the one-time latch is configured to be opened with a corresponding key or combination owned by an authorized user of the package receiving device.

21. A package receiving device for receiving a package, the package receiving device comprising:

a mounting panel for securely mounting the package receiving device onto a given fixed structure;

a bottom panel being operatively connectable to the mounting panel and being moveable with respect to said mounting panel; and at least one side panel being operatively connectable to the bottom panel and being moveable with respect to said bottom panel;

the package receiving device and the panels thereof being operable between at least one first configuration where the mounting, bottom and side panels are collapsed onto one another into a reduced space, with the at least one side panel being placeable between the bottom and mounting panels, and being containable within a spanning width defined by said bottom and mounting panels, the package receiving device and the thereof being further operable into at least one second configuration where the panels are deployed and positioned with respect to one another in order to define a containment space being shaped and sized for containing the package therein;

wherein the package receiving device includes a slot for receiving mail therethrough, the packaging receiving device further having at least one of the following components and features:

wherein the slot for receiving mail is provided with an adjacent symbol being representative of mail for indicating to user of the package receiving device an intended use of said slot;

wherein the slot is provided about an upper portion of the package receiving device when operated in the at least one first configuration; and wherein the slot is operatively provided about the bottom panel of the package receiving device.

* * * * *